US008123495B2

(12) United States Patent
Di Foggia et al.

(10) Patent No.: US 8,123,495 B2
(45) Date of Patent: Feb. 28, 2012

(54) RECIPROCATING POSITIVE-DISPLACEMENT COMPRESSORS

(75) Inventors: Andrea Di Foggia, Gricignano di Aversa (IT); Mariano Migliaccio, Naples (IT); Ottavio Pennacchia, Aversa (IT)

(73) Assignee: LA.ME. s.r.l, Gricignano di Aversa (CE) (IT)

( * ) Notice: Subject to any disclaimer, the term of this patent is extended or adjusted under 35 U.S.C. 154(b) by 536 days.

(21) Appl. No.: 12/439,033

(22) PCT Filed: Aug. 6, 2007

(86) PCT No.: PCT/IT2007/000570
§ 371 (c)(1), (2), (4) Date: Feb. 26, 2009

(87) PCT Pub. No.: WO2008/026232
PCT Pub. Date: Mar. 6, 2008

(65) Prior Publication Data

US 2010/0014992 A1 Jan. 21, 2010

(30) Foreign Application Priority Data

Aug. 31, 2006 (IT) ..... RM2006A0461

(51) Int. Cl.
*F04B 25/00* (2006.01)

(52) U.S. Cl. ..... 417/254; 417/523

(58) Field of Classification Search ..... 417/254, 417/417, 328, 363, 523, 244, 260, 262, 265
See application file for complete search history.

(56) References Cited

FOREIGN PATENT DOCUMENTS

| | | |
|---|---|---|
| BE | 1012883 | 5/2001 |
| EP | 1041283 | 10/2000 |
| EP | 1255042 | 11/2002 |
| EP | 1310687 | 5/2003 |
| WO | 02063184 | 8/2002 |

OTHER PUBLICATIONS

International Search Report, dated Dec. 12, 2007, in PCT application.

*Primary Examiner* — Joseph L Williams
(74) *Attorney, Agent, or Firm* — Young & Thompson

(57) ABSTRACT

A positive-displacement reciprocating compressor comprising a "non-conventional" crank mechanism which eliminates the amount of frictional force between the wall of the piston and the wall of the cylinder, whose characteristic feature is to have a planet (20) made of sintered material, with self-lubrication properties, allowing to eliminate bushings or similar additional elements. An economical and structurally simple lubrication system, which preferably comprises a classical link rod/crank mechanism, utilizes the mechanical energy provided by the drive shaft of the compressor and sends the lubricant (oil) in a precise manner to the surfaces that need to be lubricated. This oil is easily retained by the very small grains of the sintered material. Moreover, a valve system based on a single plate simplifies the structure of the cylinder unit (30).

21 Claims, 14 Drawing Sheets

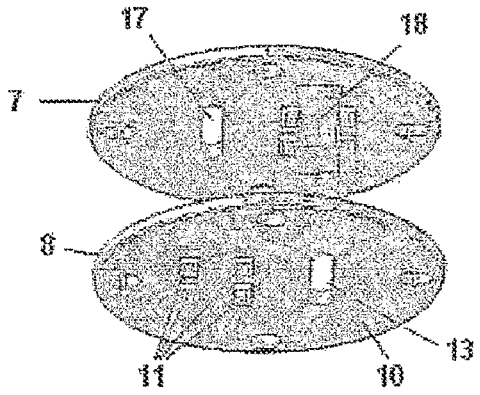
Figura 9a
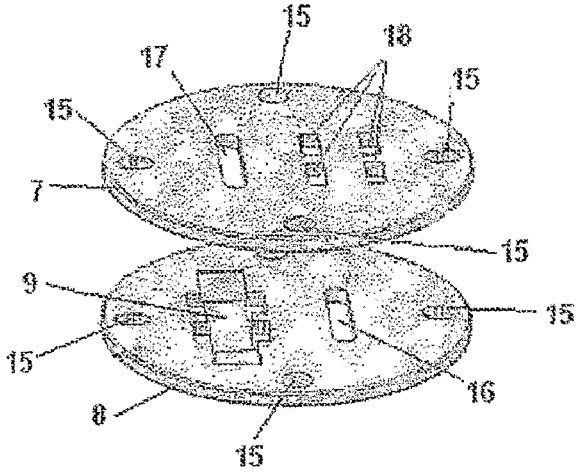
Figura 9b
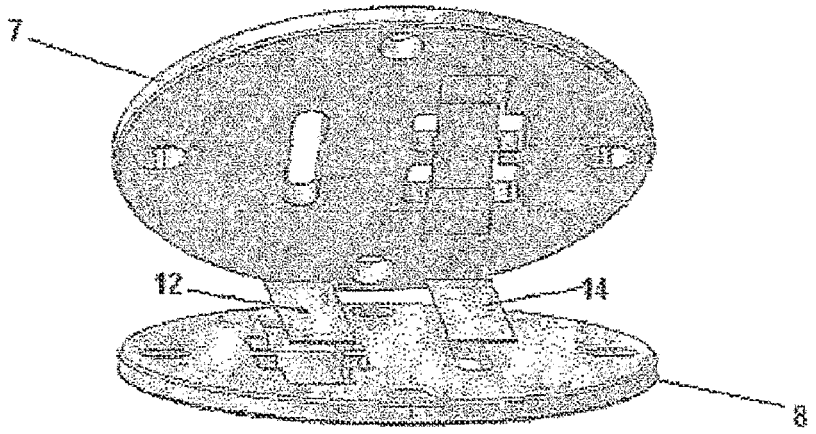
Fig.10

RECIPROCATING POSITIVE-DISPLACEMENT COMPRESSORS

TECHNICAL FIELD

The present invention relates to improvements made in positive displacement, single-stage and/or multistage compressors. Compressors belong to a class of work-performing machines and have innumerable applications in nearly any technical field (plants making use of compressed air, operation of pneumatic hammers, brakes for road/railway vehicles, actuation of machines in mines, compressed air supply to plants used for filling bombs (bottles), refrigeration plants, heat pumps, etc.).

The above improvements concern:

a) a specific crank mechanism, hereinafter called "non-conventional", realised in a material with excellent tribological features, and associated with a specific lubrication system;

b) a particular valve system including suction and delivery valves, which has many advantages, for instance a greater reliability of the compressor, a reduced number of components, easy assembling, etc.

BACKGROUND ART

Positive-displacement, reciprocating compressors generally operate by increasing the pressure value of a gaseous fluid through the mechanical energy drawn from an electrical motor or a combustion engine.

Compressors based on the classical crank mechanism (see FIG. 1) for converting a rotational motion of a motor into a rectilinear reciprocating motion, have various drawbacks, the most important of which are:

The amount of frictional force, shortened as "Fia", which adds to the force due to the action of the gases on the seals (piston rings or packing rings), and which acts between the piston side wall and the cylinder wall during the sliding of the piston, because of the reaction to the thrust exerted by the obliquity of the piston rod (connecting rod);

the overturning action exerted by the piston rod on the piston, for which reason the latter usually has a sufficient length to limit this action and to reduce the risk of seizure, thus causing, however, a dimensional and weight increase with a concomitant increase of inertial forces.

The law of motion of the piston is not perfectly sinusoidal but contains harmonics of higher order, and this causes the well known balance difficulties. These harmonics, including the lowest order one, cannot simply be balanced by counterweights; instead, they require the utilisation of counter-rotating shafts. Actually, a principle of the background art that would brilliantly solve the inherent problems of the conventional crank mechanism, is shown in FIGS. 2 and 3 and in FIG. 4 and 5.

In this crank mechanism, by imposing a rotation on the shaft with trace O (planet carrier), the element ΩB (pinion) will move in such a way that point B will displace itself along the cylinder axis in a rectilinear manner. Several known techniques have put into practice the just described mechanism (called from now on "non-conventional", though already known, only to distinguish it from the classical crank mechanism), but nonetheless, they have not been successful since they offer technical solutions that have some inconsistencies and prevent a correct operation, while in other cases they result in a great structural complexity which discourages their use.

As matter of fact, this technology has not been converted into an effective industrial application, notwithstanding the fact that some solutions appear to be valid; this is due to the complex structure, and to space and reliability problems, which render this system less competitive than the classical crank mechanism in the configurations proposed until now.

Summing up, this "non-conventional", or "non-classical" crank mechanism, which is schematically shown in FIGS. 2, 3, 4, 5 and which has been adopted by the present invention, but which has been further improved in a way to be described later, has the following features.

We start with the classical crank mechanism (FIG. 1) and split the connecting rod (piston rod) OB in two identical parts, thereby obtaining two cranks OΩ and ΩB (FIG. 2). By imposing on the crank OΩ an anticlockwise rotation, and on the crank ΩB an identical but opposite rotation "-α", point B necessarily moves rectilinearly along the cylinder axis.

Thus, the angle formed between the connecting rod and the cylinder axis is constantly equal to zero, and consequently, the component of the forces "N", normal to this axis, which are due to the connecting rod obliquity, reduces to zero. On the other hand, since no relative rotation exists between the connecting rod and the piston, there is no need, anymore, to provide a hinged connection at point C as in the classical crank mechanism; in other words, the gudgeon pin can be eliminated altogether and the connecting rod may be integrally formed with the piston. From the point of view of their practical realisation, the motions of the crank OΩ and of the auxiliary crank ΩB may be obtained using a pair of gearwheels, one of which has an inner toothing, centre O, is fixed with respect to a frame and has a pitch diameter 2r, while the second gearwheel has an external toothing with pitch diameter r, it meshes with the first gearwheel, and rotates around the axis passing through Ω which is integral with the crank (FIG. 3). Two possible practical realisations of this "non-conventional" crank mechanism are respectively shown in FIG. 4 and FIG. 5. This is actually a particular planetary gear train (FIG. 6) in which the central gear (the sun) 1 is absent and the crown wheel 2 is blocked (FIG. 7).

In this gear train, the crank OΩ forms the planet carrier 3 whereas the gearwheel with external toothing forms the pinion 4. From a kinematical viewpoint, the planet carrier 3 only rotates around its own axis (Oz), whereas the pinion or planet 4 is characterised by a composite motion, one motion consisting of a rotation around the axis through Ω, and the other, of a revolution around the axis passing through O, together with the planet carrier 3.

Considering two levorotatory reference frames $O_{xyz}$ and $O_{\xi\eta z}$ in which the first one is an absolute frame "integral" with the crown wheel 2 with internal toothing, and the second one is a relative frame "integral" with the planet carrier, their common axis z being perpendicular to the plane of motion, and imposing a rotation $\alpha_t=\alpha_z$ to the planet carrier (and therefore to the reference frame Q with respect to the reference frame $O_{xyz}$, it follows that the planet 4—being obliged to mesh with a gearwheel with twice its pitch radius—will rotate by an angle $\alpha_r=-2\alpha_z$ with respect to the planet carrier 3, that is, with respect to the relative reference frame $\Omega_{\xi\eta z}$; therefore, the angle of rotation of the planet 4 with respect to the absolute reference frame $O_{xyz}$ will be $\alpha_a=\alpha_r+\alpha_t=-2\alpha_z+\alpha_z=-\alpha_z$. FIG. 8 shows various positions of the "non-conventional" crank mechanism of the background art, for various crank angles α. Assuming point B to be fixed to ("integral with") the planet 4, the path (trajectory) of this point during the rotation of the planet carrier 3, in the absolute frame, will be a rectilinear segment. Point B can be embodied, in practice, by a pin and a bush, wherein the piston 5 may be connected to the planet 4 by a rod 6, attached to the piston without a hinge and on the planet 4 through said pin. As already mentioned, there are various known techniques which have put into practice the above described kinematical system; however, they were unsuccessful in practice since they offer technical solutions that have some inconsistencies and render impossible a correct operation, while in other cases they result in a great structural complexity which discourages their use.

The following list includes some filed patent applications based on the above operation principle:

U.S. Pat. No. 2,271,766 filed Feb. 3, 1942 of H. A. HUEBOTTER

U.S. Pat. No. 875,110 filed Apr. 30, 1953 of Harald Schultze, Bochum

U.S. Pat. No. 3,626,786 filed Dec. 14, 1971 of Haruo Kinoshita et al.

U.S. Pat. No. 3,791,227 filed Feb. 12, 1974 of Myron E. Cherry

Patent No. DE 36 04 254 A1 filed Feb. 11, 1986 of TRAN, Ton Dat

Patent No. DE 44 31 726 A1 filed Sep. 6, 1994 of Hans Gerhards

Italian Patent No. 1309063 of LAME S.r.l.

As a matter of fact, though they take advantage of a "non-conventional" crank mechanism which is undoubtedly better than the classical one (because of the above reasons), no one of the above mentioned patents has in practice been applied industrially to positive-displacement reciprocating compressors, notwithstanding the fact that some of these solutions of the background art seem to be valid; actually, often the structural complexity was excessive, space problems arose, and reliability was insufficient. These problems have rendered uncompetitive the "non-conventional" crank mechanism with respect to the classical one.

Therefore, it is desirable to provide a compressor that operates according to a "non-conventional" crank mechanism but which has—in contrast with the background art—the advantages of a reduced size, increased reliability, less components (resulting in a facilitated assembling and structural simplicity), together with self-lubrication features for the constituent material of the components in relative motion of the crank mechanism. Moreover, it is desirable to use a processing technique that lowers production costs of the mechanical parts of the "non-conventional" crank mechanism.

Furthermore, compressors of the background art obviously require that a certain amount of lubricant, usually oil, be fed to the components which are in relative motion.

To supply the necessary amount of liquid lubricant, compressors must be provided with lubrication systems capable of feeding even very modest lubricant flow rates but delivering them where they are actually needed; further, these lubrication systems must have a simple mechanics, low production costs, be capable of drawing the motion from the machine on which they are mounted without resorting to excessively complicated mechanisms (additional small shafts (spindles), power takeoffs, etc). At present, the lubrication of reciprocating compressors is essentially performed either by splash lubrication—provided this system reveals itself sufficient—or by means of gear pumps, if the needs of a good lubrication are more strict. Recently, electromagnetically controlled pumps, or small reciprocating, mechanically controlled pumps (generally based on cams) have also been devised, for instance in small-sized internal combustion engines for scooters or motorcycles. The present invention is a valid alternative to conventionally used solutions like those employed in the field of the lubrication systems for positive-displacement compressors.

The alternative proposed by the present invention consist of a lubrication system which, during operation, directly draws the mechanical energy necessary for its motion from the driving shaft of the compressor, and lubricates in an accurate (targeted) manner those components of the "non-conventional" crank mechanism—of the compressor—which are in relative motion with respect to each other. This system has a very convenient cost, it does not require power takeoffs or independent drive means, it is extremely easy to assemble, and it does not "waste" lubricant oil since it directs the latter exactly towards those parts which are in relative motion. It will be noted, in the detailed description of the invention, that in combination with a "non-conventional" crank mechanism provided with self-lubricant properties (due to its constituent material), this lubrication system, to be described later, will insure a perfect lubrication together with obvious economical advantages.

Although the classical splash lubrication of the background art, relying on the splashing and entrainment caused by the very components to be lubricated (which are wetted by the oil generally contained in an oil sump) has the advantage to be extremely economical and simple, provided it insures a sufficient lubrication, it has—nevertheless—considerable drawbacks, like the need to maintain a constant lubricant level inside the oil sump in order to avoid seizure. Moreover, in this way the lubricant is not accurately supplied (that is, it is not exclusively supplied to the points where it is really needed), since this system does not feed the lubricant under pressure. Moreover, this system cannot be employed in two-strokes engines with sump oil pump, since in these applications the sump oil pump must work under dry conditions.

Therefore, in the background art the lubrication under pressure has become the most widespread system because of its evident advantages linked to its utilisation, these advantages being, among others, the increase in performance of the kinematical couples lubricated under pressure as compared with that obtainable without the contribution of the feed pressure.

In particular, lubrication effected by gear pumps according to the background art offers the advantage of putting the lubrication circuit under pressure, thereby allowing to precisely reach the various points to be lubricated, with the correct oil flow rate and the required pressure. In that case the lubricant also has the not negligible task of cooling the surfaces which are in mutual contact. Also the use of cam-actuated reciprocating pumps has quickly become widespread, in the same way as electromagnetic pumps, in the field of small-sized internal combustion engines, due to the possibility of feeding the lubricant under pressure, by controlling the flow rates and therefore, taking advantage of the possibility of cooling down the various lubricated kinematical couples.

However, the disadvantage in the use of gear pumps lies in the increased cost involved in the production of high-quality mechanical components, like the gearwheels for instance, and in the need to provide an adequate power takeoff (drive), so that the machine to be lubricated will be more difficult to manufacture. On the other hand, the drawbacks of using cam-actuated pumps, in their commonly used version, are the requirement of their assembling in the vicinity of the driving shaft and the need of having available an adequate oil level in the oil sump in order to permit the priming (pump starting). The drawbacks of using electromagnetically controlled pumps are generally the increased production cost, their electric power absorption, and the necessity of providing a control unit.

Summing up, it would be desirable to provide a positive-displacement reciprocating compressor which has a targeted (accurate), economical, reliable, compact, and easily mountable lubrication system, which directly draws the power from the compressor drive shaft and does not require high-quality complex mechanical components that need complex machining for their production (case of gear pumps), and moreover, a lubrication system not requiring an excessive amount of oil in the oil sump.

A further problem of the background art relates to the system of intake valves (suction valves) and delivery (head) valves of a positive-displacement reciprocating compressor.

Compressor valves may be actuated mechanically or automatically; the first case covers for instance the valves that are actuated by means of cams; the second case includes the type of valves whose opening/closing is caused by the pressure difference existing between the upstream and downstream regions of the valve. Mechanical valves have the advantage of following a precise 'lift law' but their considerable disadvantage lies in the complex structure, the great number of auxiliary elements involved, the fact that they are excessively cumbersome, their weight and their cost. All these factors have determined a situation in which, practically, all commercial compressors used in conventional applications have been equipped with automatic valves. The commonly used automatic valve system is formed by (see FIGS. 9*a*, 9*b*, 10) two identical plates 7, 8 having appropriate seats to receive two flexible lamellar blades (which normally are made of harmonic steel). The plates 7, 8 are usually identical and are mounted face-to-face in an asymmetric manner, with the flexible lamellar blades located within these appositely realised seats, so as to form a single package, and so that the fluid flow directions allowed by the valves are opposite to each other. The valve package is usually mounted on a cylinder head of the compressor in such a manner that one side of this package directly faces the inner space of the cylinder, whereas the other side faces towards the cylinder head located above the cylinder. Normally, the cylinder head is divided in two distinct regions isolated from each other by a sealed septum or dividing wall. A first of these regions is traversed by the suction or intake flow, while a second region is traversed by the delivery flow. The first region allows the flow to enter by virtue of the depression which, generated inside the cylinder as a consequence of the descending motion of the piston from the top dead centre to the bottom dead centre, causes the opening of the intake valve. The latter is shaped so as to allow the passage of working fluid from the outside of the cylinder to the inside of the same while preventing its passage in the inverse direction. The second region allows the fluid (which has been compressed in the cylinder by the piston during the ascending stroke from the bottom dead centre to the top dead centre) to exit from the cylinder after the opening of the discharge valve. The latter is shaped so as to allow the working fluid to pass from the inside to the outside of the cylinder, while blocking the inverse path. The opening of the valves therefore occurs as a consequence of the pressure difference on the two opposite sides (faces) of each lamellar blade. This pressure difference causes the inflection of the lamellar blades—which obviously behave in this case in the same way as simple beams supported at both ends and subjected to a distributed load—, thereby opening a passage for fluid flow which is directed from the upstream region to the downstream region with respect to the blades and their valve seats. These seats are in turn realised on the plates so as to allow the inflection (bending) of each lamellar blade to take place in one direction only, and for a limited, maximum opening (bending), in such a way that the blades immediately close when the pressure gradient that caused their opening changes sign. Thus, these valves, as has already been said, essentially act as check valves.

This automatic valve system of the background art is surely efficient, and with respect to that realised by means of mechanically actuated valves it is certainly more simple and economic; however, also this system has drawbacks. The first of them is due to the inevitable increase of clearances, consisting of volumes that correspond to the necessary passage areas obtained on the surface of one of these plates used to retain the lamellar blades, in particular of that plate which directly faces the inside of the cylinder, which adds to the volume of the seat (space) that receives the suction valve (see space 9 in FIG. 9*b*). The second drawback is the presence of two asymmetrically arranged plates 7, 8 which face each other and which contain the lamellar blades, and moreover, another drawback resides in the difficulty of assembling these components and in the often occurring overheating problems of the delivery lamellar blades, which are interposed between the plates and are therefore influenced by the high temperatures of the delivery flow, without being protected by an efficient thermal exchange that would limit the maximum temperature reached by them. In the FIGS. 9*a* and 9*b* there is shown, in an exploded view, the package (assembly) of plates according to this background art and according to a usual, commercially available embodiment, in the typical arrangement in which the cylinder (not shown) is located below the two plates. FIG. 9*a* corresponds to a lower-side view, while FIG. 9*b* is an upper-side view of the two plates 7, 8. Number 8 denotes the lower plate, number 7 the upper plate. The number 10 indicates the lower face of plate 8, which is the face facing towards the cylinder inside (not shown). On this lower face 10, in its middle part, there are rectangular slits. This group of four slits 11, located on the left, forms the slits traversed by the fluid which enters the compressor by passing beyond the suction valve, when the lamellar blade 12 that forms the latter (see FIG. 10) is open. The slit arranged on the right, denoted by the number 13 in FIG. 9*a*, is the one traversed by the outgoing flow of the compressor, when, during the compression stroke, the inner pressure overcomes the outside pressure and thereby determines the opening of the lamellar blade 14 (FIG. 10) which forms the delivery valve. FIG. 9*b* shows the holes 15 used for mounting the plates on the cylinder head. These holes 15 are formed on both of the plates 7, 8 to be connected together. In FIG. 9*b* one sees the upper view of this upper plate 7. On the left, the space or seat 9 is visible, which is occupied by the lamellar blade 12 made of harmonic steel forming the suction valve, while on the right one notes a slit 16 to be traversed by the fluid under pressure that exits the cylinder. FIG. 9*a* also shows the lower face of the lower plate 8. On the left, one notes a slit 17 to be traversed by the suction flow during the opening period of the corresponding lamellar blade 12, while on the right there is a space or seat 18 occupied by the lamellar blade 14 made of harmonic steel (FIG. 10), which forms the delivery valve. In FIG. 9*b*, finally, one notes the upper face of the upper plate 7, which shows a perfectly asymmetric arrangement with respect to the lower face of the lower plate 8 as already shown in the above mentioned FIG. 9*a*. One may note the slit 17, through which the sucked fluid passes when crossing the intake or suction valve, and holes 18, which are traversed by the compressed fluid when it leaves the delivery valve whose lamellar blade is denoted by 14 in FIG. 10.

An alternative system of automatic valves according to the background art is realised by resorting to a single plate having appropriate seats used to lodge the two flexible lamellar blades (one for the suction flow and the other for the discharge flow, usually of harmonic steel), both of these valves being—however—usually connected to the plate at one of their ends, so that their opening occurs only on one side, by a simple inflection. The connection is generally obtained by a rivet or another means suited to realise a stable connection with the plate.

Now, another object of the present invention, according to a more specific embodiment of the same included in the dependent claims, is obtained by means of a realisation which provides a particular valve system in the positive-displacement reciprocating compressor.

This object consists in providing a valve system in the positive-displacement reciprocating compressor, this valve system solving some of the problems which have been mentioned previously and which are inherent problems of known automatic valve systems (which are present both in single-stage compressors and multistage compressors).

In particular, the objects that can be attained by utilising a valve system according to the present invention, are the following—as will be detailed in the subsequent, more precise description of the invention—:

(case concerning a single-stage compressor or the first stage of a multistage compressor)

- A reduction of the clearance, since the noxious volume only concerns the delivery valve. In fact, the suction valve, being directly oriented towards the interior of the cylinder, does not "add any volume" to the clearance (on the contrary, it reduces it by a small amount);
- A reduction in the number of components, since in this embodiment only one valve plate is necessary, unlike the traditional systems which employ two plates 7, 8. The component number reduction implies less machining work and reduced production costs;
- A simplification in the assembling process because of the reduced number of components, and impossibility of an erroneous assembling/mounting;
- A solution of the overheating problem for the delivery valve, because this valve, which is lodged in the delivery space or volume of the cylinder head, is no more forced to stay inside a very narrow volume surrounded by walls at high temperature. (case concerning a stage located downstream of the first stage in a multistage compressor)
- A reduction of the clearance, since the noxious volume, or space, is the sum of that volume associated with the delivery valve (which is minimal, since the valve directly faces the cylinder) and of that volume which concerns the intake valve (which is minimal due to the fact that the valve seat (valve space) has been laterally arranged with respect to the outer edge of the cylinder);
- A reduction of the number of components, since this embodiment only requires a single valve plate for the delivery valve, which also incorporates the components needed for the intake valve (suction valve), instead of the two plates of the traditional systems, which imply clearances that have a greater value, taken as a whole. Also in this case, the reduction of the number of components, and therefore the utilisation of a single plate, implies a reduction of the involved machining processes and related production costs;
- A simplification of the assembling and mounting process, due to the utilisation of a single plate and a resulting impossibility of erroneous assembling;
- A solution to the delivery valve overheating problem, since this valve, which is lodged inside the delivery volume of the cylinder head, is no more forced to stay inside a very narrow volume surrounded by walls at high temperature;
- Elimination of the heat exchange (heat transmission) between the sucked fluid and the compressed fluid; this heat exchange taking place in traditional systems through the thin septum (dividing wall) located between the adjacent volumes present inside the cylinder head. In the proposed system, the sucked fluid is not subjected to such heating; which consequently reduces the work expended during compression.

DISCLOSURE OF INVENTION

According to claim 1, the present invention attains its main objects by realising a planet made of sintered material, whose microgranules have a self-lubricating property and therefore retain the oil lubricant for a longer period. Therefore, it is not necessary to use bushings, interposed between the planet carrier and the planet. This simplifies the structure of the crank mechanism, and it increases the reliability of the compressor. Moreover, by combining the aforesaid properties with a lubrication system which is accurate, and which directly draws the power from the drive shaft in order to deliver the oil under pressure to the surfaces that need to be lubricated, an even greater constructive simplicity is obtained.

Preferably (see claim 2) the lubrication system takes advantage of a classical crank mechanism.

Other features of the compressor are contained in the remaining dependent claims. In particular, the valve system with a single plate prevents overheating of the delivery valves, which are freely movable at their ends.

BRIEF DESCRIPTION OF DRAWINGS

The present invention will be described with reference to some specific embodiments, which are only illustrative but neither limitative nor binding with regard to the inventive concept, these embodiments being illustrated in the annexed drawings, wherein:

FIG. 9*a* is a perspective view, according to a first (upwardly inclined) direction of observation, of a pair of plates of a suction-and-delivery valve system in accordance with the known art;

FIG. 9*b* is a perspective view, according to a second (downwardly inclined) direction of observation, of the same pair of plates of the suction-and-delivery valve system in accordance with the known art, as already shown in FIG. 9*a;*

FIG. 10 is a view analogous to FIGS. 9*a* and 9*b*, which also shows, however, the lamellar blades, that is, the suction-valve lamellar blade (12) and the delivery-valve lamellar blade (14), which must be inserted into respective seats between the two plates (7, 8), while the latter must be bolted (see holes 15) onto the cylinder head (not shown) of a background art compressor;

DETAILED DESCRIPTION OF PREFERRED EMBODIMENTS

Some preferred embodiments of the invention will now be described for illustrative but non-limitative purposes. A skilled person will easily find equivalent solutions, included in the same inventive concept, which are therefore protected by the present patent application.

Figure 1:
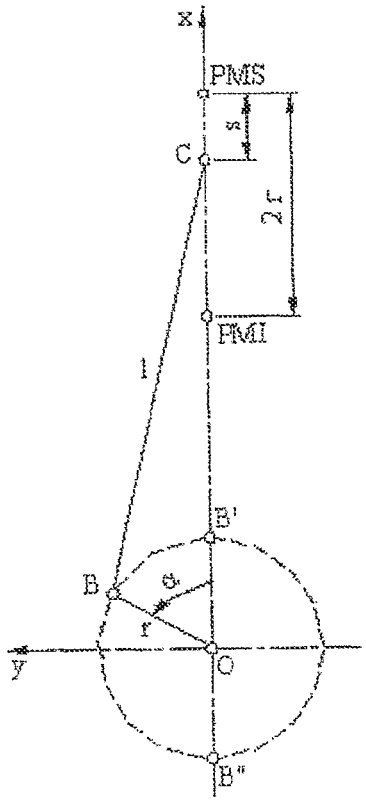
Fig.1 PRIOR ART
FIG. 1 schematically shows the classical crank mechanism.
Figure 2:
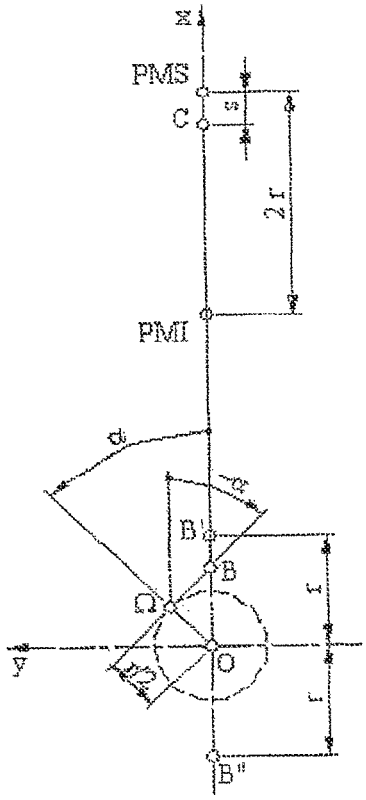
Fig. 2 PRIOR ART
FIG. 2 schematically shows a "non-conventional" crank mechanism, according to the above definition.
Figure 3:
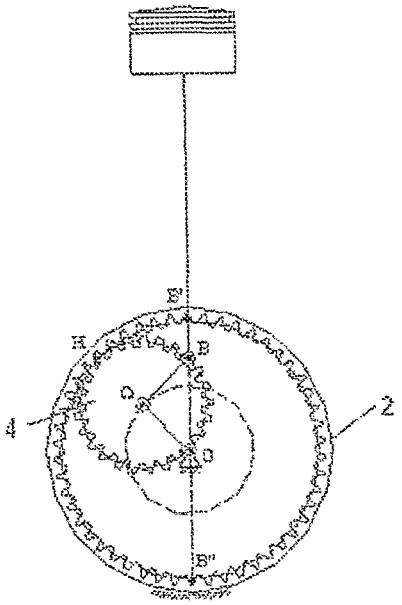
Fig.3 PRIOR ART
FIG. 3 is a schematic representation of the pinion (4) of radius O-Ω which meshes with the internal gear (2) having twice that radius, that is, radius O-H, in a "non-conventional" crank mechanism, according to the background art.

Because of the various drawbacks of the classical crank mechanism, some of which have been briefly described in the introductory part of the present patent application, the present invention suggests to realize a positive-displacement reciprocating compressor based on the design of a "non-conventional" crank mechanism (FIGS. 2 and 3) which overcomes the disadvantages of the background art.

Figure 11:
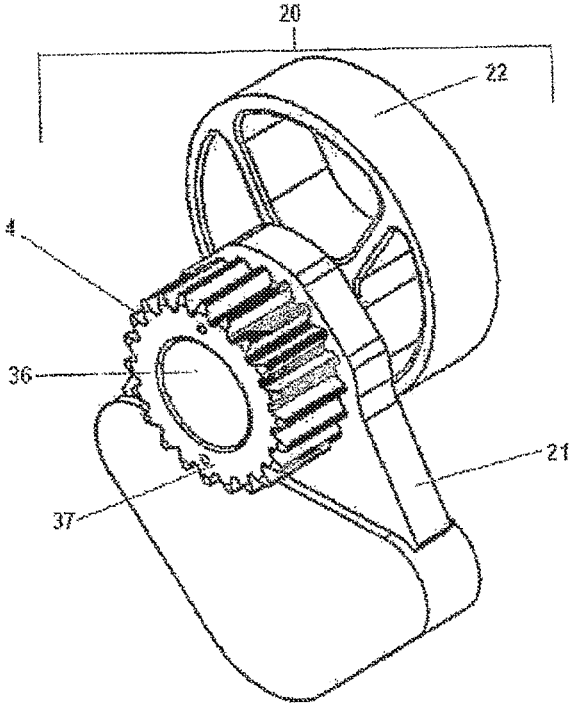
FIG. 11 is a perspective view of the planet according to the implementation shown in FIG. 5 of a "non-conventional" crank mechanism, wherein, according to the present invention, the planet is realised by means of a sintering process.
Figure 13:
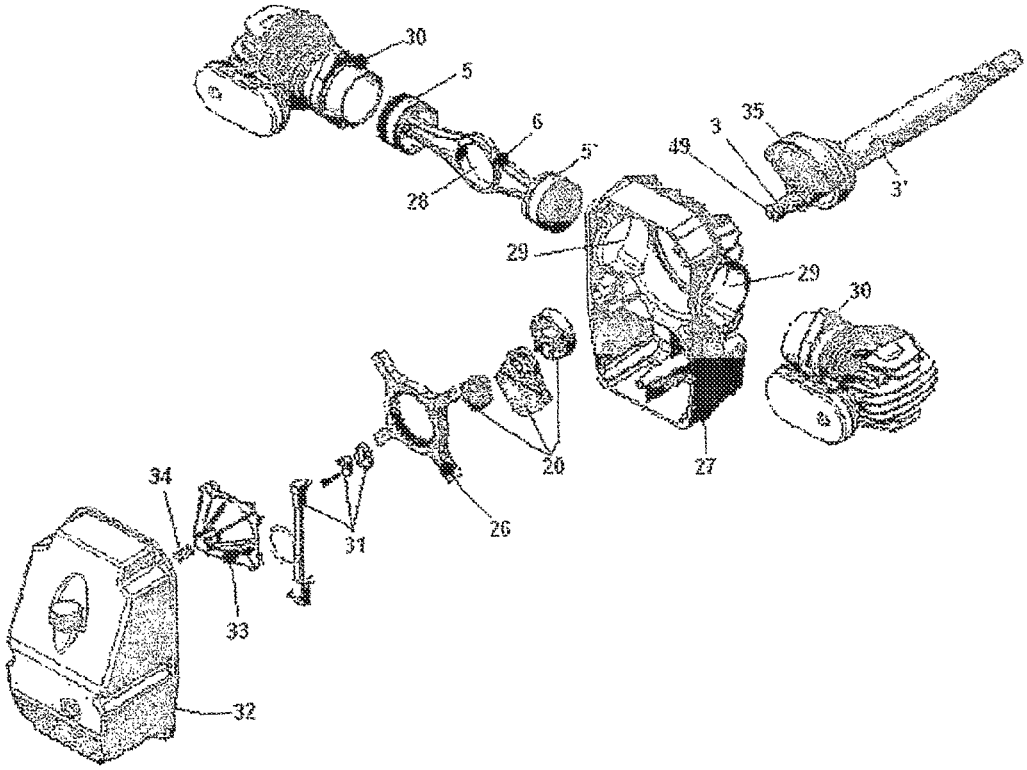
FIG. 13 is an exploded view of a positive-displacement reciprocating compressor, in a specific, non-binding embodiment of the present invention, including the planet shown in FIG. 12.
Figure 12:
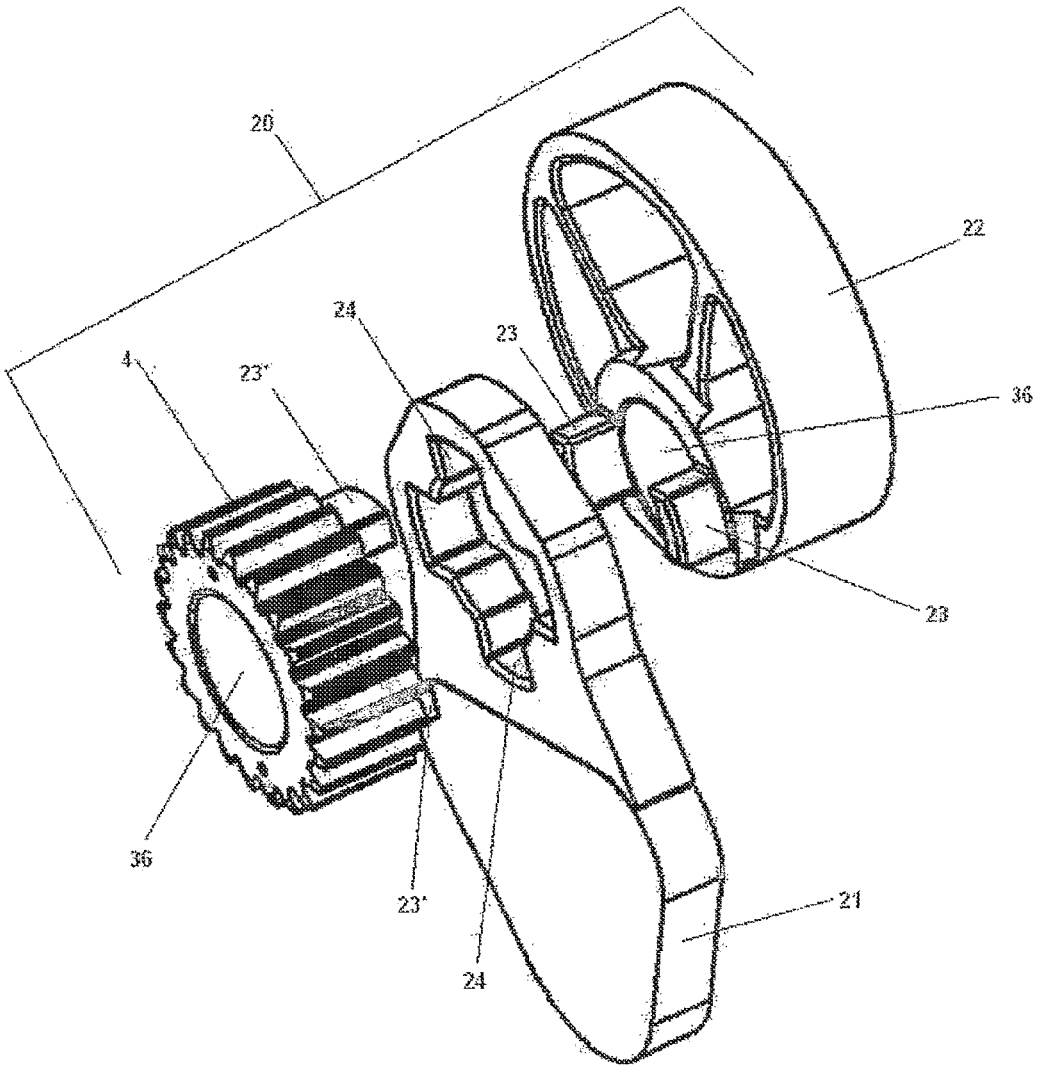
FIG. 12 is an exploded view of the planet according to FIG. 11, in the preferred embodiment of the invention in which the same is not realised in a single piece, but comprises several individual parts of sintered material to be assembled together.
Figure 14:
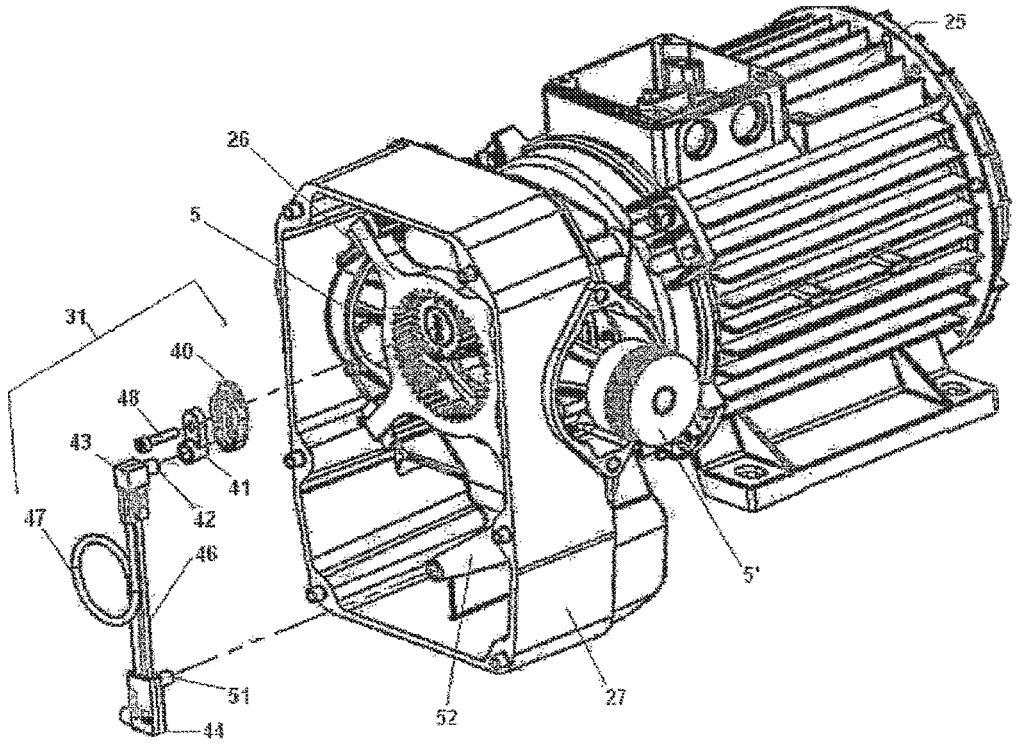
FIG. 14 is a view of the positive-displacement reciprocating compressor of the present invention, as already shown in FIG. 13, but this time in a partially assembled state exhibiting the positive-displacement pump (of the lubrication oil) in accordance with the present invention.
Figure 15:
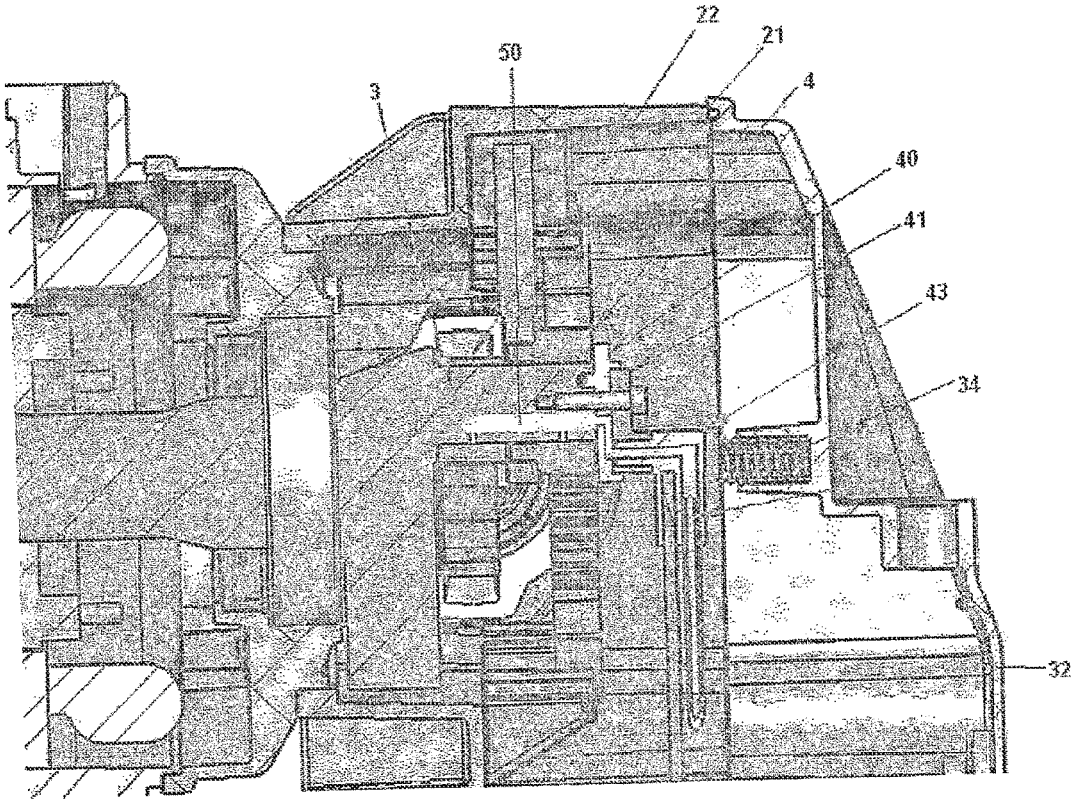
FIG. 15 is a partial view, according to an axial, vertical cross-section, of the positive-displacement reciprocating compressor of the invention, from which it is possible to see the path of the oil through the needle-like piston pump (accurate lubrication system according to the invention) and through the eccentric protrusion (planet carrier) integral to the drive shaft.

Such a reciprocating compressor is for example generally illustrated in FIG. 13. FIG. 13 shows a two-cylinder, positive-displacement reciprocating compressor according to the invention, which has been realised by employing the technology of sintered materials (this concept and its advantages will be explained below), the compressor including:

- a planet 20, obtained using the technology of sintered materials, and comprising (see FIG. 12) a pinion 4 (gearwheel with external toothing), a counterweight 21, and an eccentric disk 22 (FIG. 11 shows the three pieces 4, 21, 22 assembled simply by inserting the fins 23, 23' of the eccentric disk 22 and respectively of the pinion 4 inside the cross-like apertures 24 of the counterweight 21; note that the planet shown in FIG. 11 could also form a single piece, in one embodiment;
- a gearwheel with internal toothing (crown wheel) 2, which is also realised by the
technology of sintered materials;
- a planet carrier 3 which is connected to the drive shaft 3' and which is actuated by the electric motor 25 (FIG. 14); FIG. 14 shows a partial assembling of the compressor of FIG. 13 (note the crown wheel with internal toothing 2 which is inserted by means of its four cross-shaped arms 26 in respective seats integral with the housing 27);
- two pistons 5, 5' which are provided at the ends of a single stem or rod 6 having a central hole 28 apt to receive the eccentric disk 22 after the component 5, 5', 6 has been inserted through the holes 29, 29 (see FIG. 14) of the housing 27, with the central hole 28 of the rod 6 being then located substantially in a central position inside the housing 27;
- two complete cylinder units 30 (cylinder, cylinder head, valve systems, etc.);
- a lubrication system 31, consisting of various components that will be described in detail hereinafter;
- the housing 27;
- a cover 32 (not shown in FIG. 14) of the housing 27;
- a dome-shaped element, 33, having a respective helical spring 34, interposed between the cover 32 and the housing 27; the element 33, elastically bound to the cover, has the function of retaining in its position the oil pump of the lubrication system 31 and the component 26 of the compressor.

Figure 8:
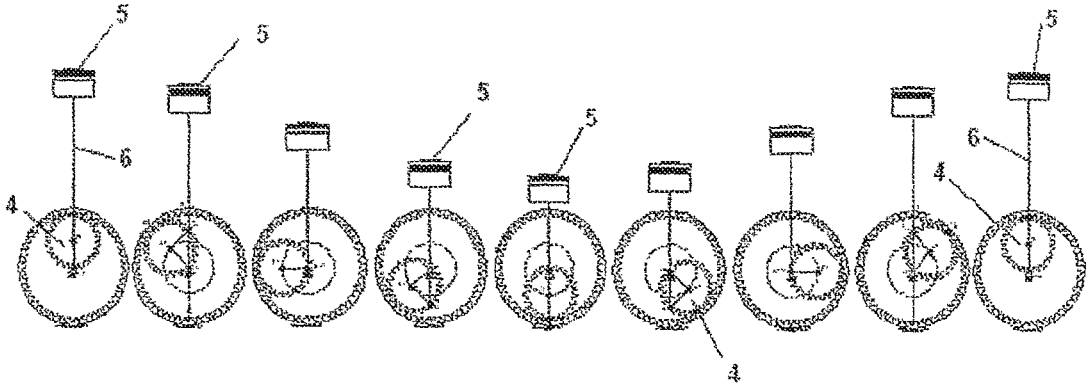
FIG. 8 shows various positions during the operation of a "non-conventional" crank mechanism.

The number 35 denotes a counterweight of the driving shaft 3'. The planet carrier 3 is introduced through the axial bore 36 of the planet 20, and when the components 4, 21, 22 have all been inserted on the plant carrier 3, the free end of the planet carrier 3 will be flush with the face 37 (FIG. 11) of the pinion 4, as may be seen from FIG. 14. The compressor of FIG. 13 contains a "non-conventional" crank mechanism of the kind depicted in FIG. 5. In this figure, a single piston 6 is shown for simplicity, although, obviously, point B denotes the centre of the eccentric disk 22, and this point B moves during the operation along an ideal (imaginary) straight line forming an extension of the rod 6, so that the pistons 5, 5' will move along a straight line (vertical line in FIG. 5 but horizontal in FIGS. 13 and 14). In the top and bottom dead centres, the centre of the eccentric disk 22 (point B), or better its "trace" (intersection with ideal plane) will lie on the pitch circle (pitch line) of the crown wheel 2 (denoted by 26 in FIGS. 13 and 14), as follows from FIG. 5, left side. Note that in all phases of the movement, the "trace" of point B (centre of eccentric disk 22) lies on the pitch line of the pinion 4 (see also FIG. 8).

Figure 4:
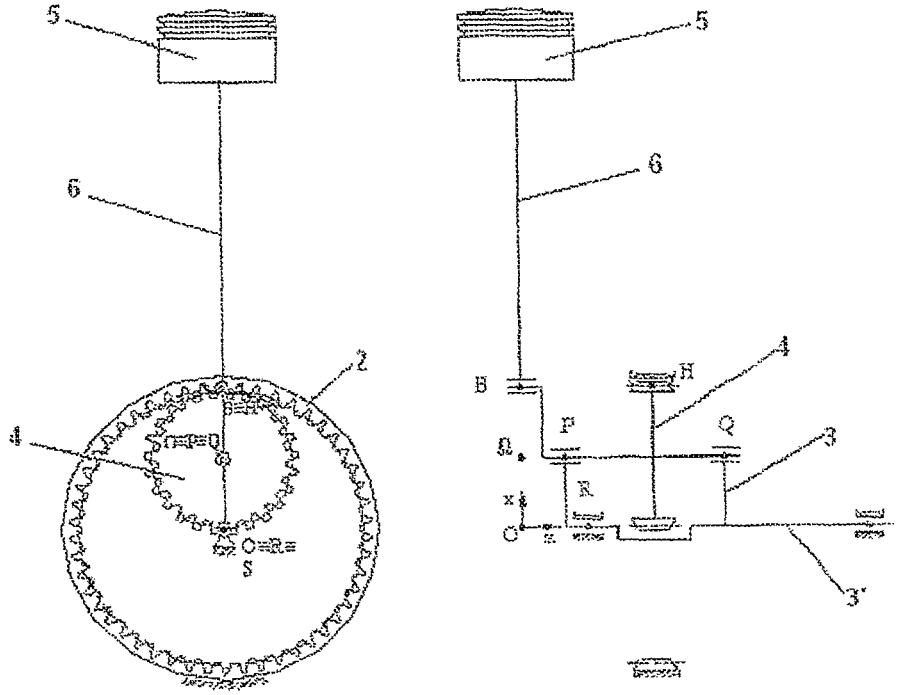
FIG. 4 is a schematic representation of a possible, first implementation (concrete realisation) of the "non-conventional", that is non-classical, crank mechanism.
Figure 5:
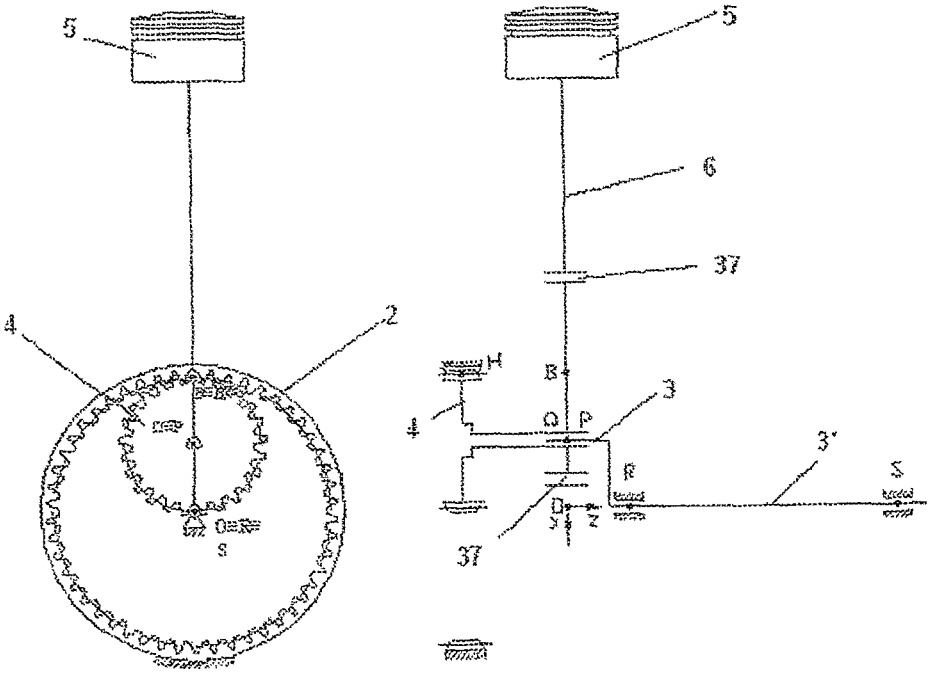
FIG. 5 is a schematic drawing of a second, possible implementation of the "non-conventional" crank mechanism, in the specific embodiment of the invention that will be detailed in the following part of the description, and to which the improvements according to the invention will be applied.
Figure 6:
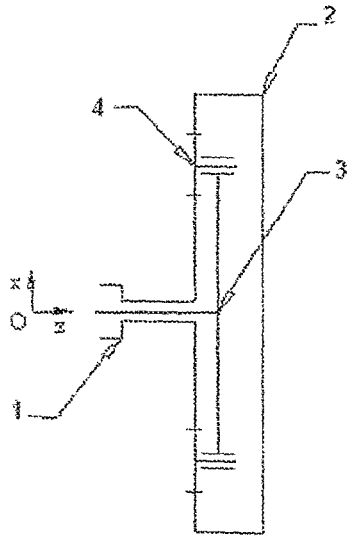
FIG. 6 schematically shows a generally known planetary gear train according to the known art, comprising a pinion 4, an internal gear 2, and a sun gear (central gearwheel) 1.
Figure 7:
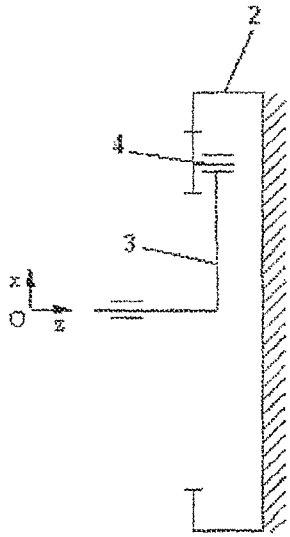
FIG. 7 schematically shows: the planet carrier 3, or crank (connected to the drive shaft Oz), which supports the pinion 4, and finally the fixed internal gear 2, as a particular case of the planetary gear train of FIG. 6 (in which the sun gear 1 disappears) and as a further illustration of the concept of "non-conventional" crank mechanism.

FIG. 4 shows another possible concrete embodiment of "non-conventional" crank mechanism to which the present invention can be applied, although FIGS. 13 and 14 only refer to the embodiment which is schematically shown in FIG. 5.

The points denoted by 37 in FIG. 5 correspond to the contact zone of relative motion between the internal wall of the bore 28 and the external side wall of the eccentric disk 22'. Point P in FIG. 5 denotes the introduction of the planet carrier 3 inside the hole 36 of the pinion 4 (bore 36 of the planet 20). In FIG. 5 the counterweight 21 is not shown.

After this description of the operation and structure of the "non-conventional" crank mechanism of the compressor, the main aspect of the present invention will be illustrated.

Actually, none of the inventions previously mentioned in the paragraph "Background Art" has been applied industrially in a practical way, notwithstanding the fact that some of them seem to be valid, this being due to their complex structure, the fact that they are cumbersome, and their reliability level, these problems lowering the degree of usefulness of the arrangements proposed hitherto with respect to the classical crank mechanism. It is believed that the solution suited to render industrially useful the production of compressors that are based on such a kind of "non-conventional" crank mechanism, is that of utilising the technology of sintering processes (in particular of steel) for the realisation of the planet. With this technology it is actually possible to realise planets in a monolithic configuration (FIG. 11) or, even better, in more pieces (components) (FIG. 12), with the advantage of considerably lowering the production costs, because of the low costs involved in this technology (with respect to other technologies) and because of the fact that it is possible to obtain a finished planet (including the gearwheels) in accordance with the design tolerances without the need of complex mechanical machining, so that the planet will be ready for assembling purposes once the relative pieces have been subjected to possible thermal treatments (if any) such as carburizing and sinter-hardening; the latter technology, which has been developed in the latest years, is applied during the same process of sintering. By realising the planet according to this technology it is possible to solve the problems of structural complexity and space, since the planet realised in this manner can be directly mounted on the planet carrier 3 without any interposition of bushings, because of the excellent tribological properties of the sintered materials; moreover, this material, due to its texture made of micro-granules, has optimum properties of resistance to fatigue and has yield stresses and limits of breaking stresses which are near to those of the compact materials.

Moreover, the sintered material composed of micro-granules absorbs the lubrication oil and insures a better lubrication for a longer period. Combined with the lubrication system 31, one will obtain an optimum and precise lubrication at very convenient costs.

The sintered material has self-lubrication properties and therefore it allows to eliminate the bushings between the surfaces in relative motion; moreover, its structure made of micro-granules absorbs oil for a longer period of time. The planet 20 may be realised in a single piece (as shown in FIG. 11) or in more pieces (components) (FIG. 12) to be assembled afterwards. In the first case, this more complex geometry can be obtained by using a mould, without complex mechanical machining. In case of more components, all made of sintered material, the single moulds can be made even more simple, and this greatly facilitates the production process. In any case, it is possible to comply with design tolerances without being forced to use complex mechanical machining processes, unlike the case of components which are not made of sintered material.

According to the present invention, moreover, also the crown wheel 26 (2) is preferably made of sintered material.

Another aspect of the present invention will now be described in detail. This aspect concerns the accurate lubrication of the surfaces which are in relative motion, in particular of the contact zone between the planet carrier 3 and the planet 20 (the wall of the bore 36).

Lubrication is performed according to the present invention by means of a pump which draws the power necessary for its motion from the drive shaft 3', that is, from the planet carrier 3 which is integral with the latter, in order to pump the oil directly to the surfaces that need lubrication. This oil will then also reach the outer surface of the eccentric disk 22 and the wall of the bore 28 (zone 37 in FIG. 5) which is in contact with the latter. Since the oil present on the lower part of the housing 27 (oil sump) is fed in a precise manner to the surfaces which need lubrication, it will be possible to provide a minimum quantity of oil inside the housing.

In the preferred embodiment of the lubrication system, the motion is drawn from the drive shaft 3' and is transmitted to a positive-displacement reciprocating pump having a crank 41 and a piston 46, said pump being generally indicated by the number 31 in FIGS. 13, 14, 15 and 16. The lubrication system 31 includes a crank carrier 40 having a seat for the crank 41, the latter having a cylindrical seat which receives in an articulated manner a cylindrical projection 42 of the actual pump. The pump also includes a piston-pump-body 43 which is rigidly connected to the piston 46 that pumps the oil, and a cylinder-pump 44, apt to receive the oil (sucked during the suction stroke (intake stroke) of the piston 46 which slides inside the cylinder-pump 44), from the lower side of the housing 27 (oil level inside the housing 27 is not shown in the drawings). The cylinder-pump 44 is pivotally connected, by means of a pin 51, to a conical portion 52 having an inner bore apt to receive said pin 51. The oil is sucked through the window or aperture 45 (FIG. 16) of the cylinder-pump 44, in a way which will be described in more detail hereinafter, and then it is supplied under pressure—during the pump piston 46 delivery stroke—to the inside of the small flexible tube or hose 47, which in turn is in fluid communication with the interior of the piston-pump-body 43. The pump 31 is mounted on the free side (free end) 49 of the planet carrier 3 (see FIGS. 13 and 14) by means of the screw 48, which fastens the crank 41 of the pump inside the respective seat of the crank carrier 40 and the reby fixes the components 40, 41 to the free side 49 of the planet carrier. The screw 48 is introduced (see FIG. 14) through respective holes of the components 40, 41 after a preliminary alignment of these holes with respect to the central hole of a series of three holes (located on a straight line) arranged on the plane surface 49 (FIG. 14). After the introduction of the screw in this central hole, this screw 48 rigidly connects (that is, fastens to each other) the components 41, 40 and 3, preventing the planet 20 from slipping out of the planet carrier 3 (because of the presence of the crank carrier 40). An axial bore of the protrusion 42 introduced in a sealed and pivotal manner into the cylindrical seat of the crank 41, is in fluid communication on the one side—with the oil under pressure coming from the small flexible tube (hose) 47 and—on the opposite side—with the lower hole (in FIG. 14) of said series of three holes present on the free plane surface 49 of the planet carrier 3 (also by virtue of a slot present on the component 40). This lower hole in the planet carrier, indicated by 50 in FIG. 15, extends axially in the planet carrier 3 and ends into two radial bores (FIG. 15) used to lubricate the aforesaid surfaces which are in mutual rotational contact, of the eccentric disk 22, the counterweight 21 and the pinion 4, on one side, and the planet carrier 3, on the other.

Figure 16:
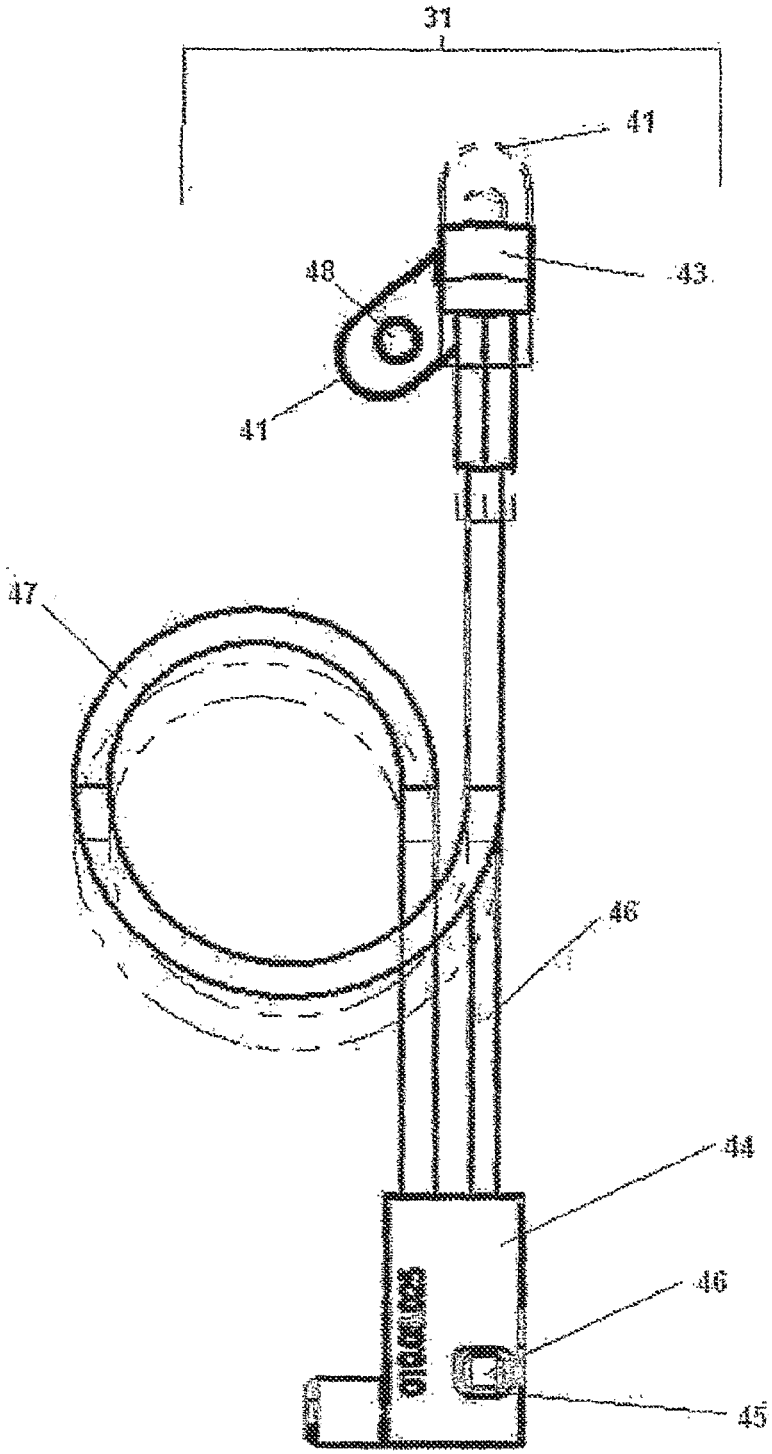
FIG. 16 is a front view of the reciprocating pump according to the invention, which performs a precise lubrication and is shown isolated, wherein two positions of the crank of the pump are shown in this drawing (position in solid line=generic position; position in broken line=delivery position)

FIG. 16 shows two possible operative positions of the pump; broken line=crank 41 in the delivery position, hose 47 "compressed" in order to compensate for the reduced distance between the components 43 and 44 (piston-pump-body and cylinder-pump), solid lines=generic position of the crank 41 (oil suction).

Figure 17:
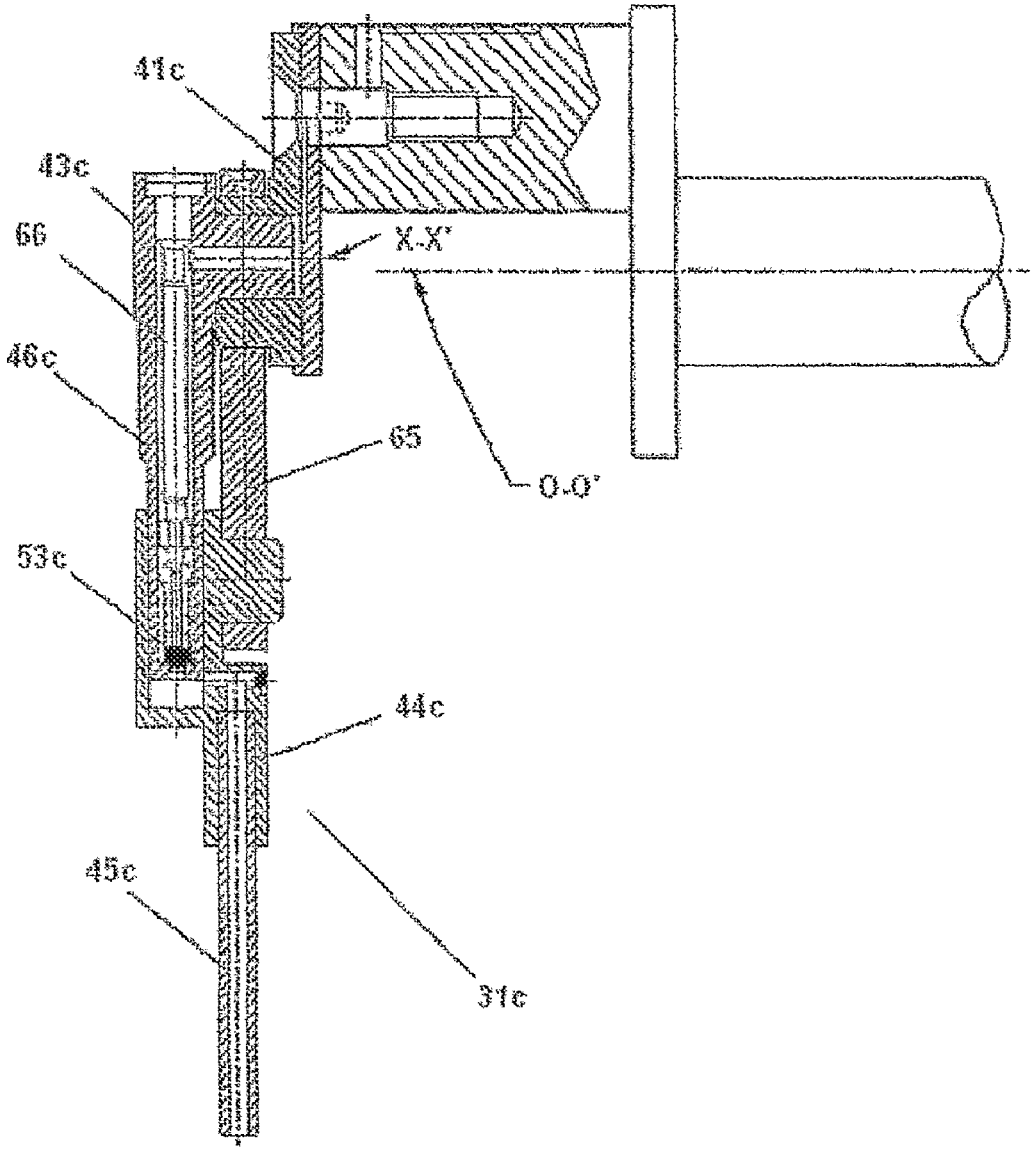
FIG. 17 is a first embodiment ("A-version") of reciprocating pump performing an accurate lubrication, according to the present invention.
Figure 18:
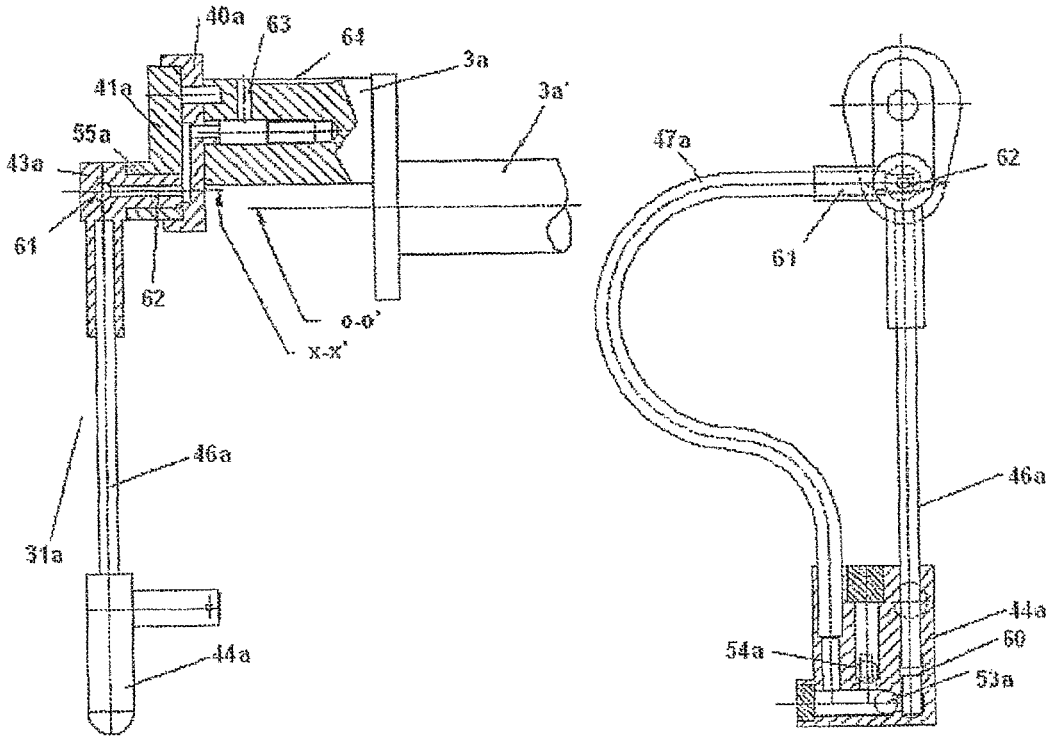
FIG. 18 shows a second embodiment ("B-version") of reciprocating pump of the invention, corresponding essentially to the versions shown in FIGS. 13, 14 and individually in FIG. 16.
Figure 19:
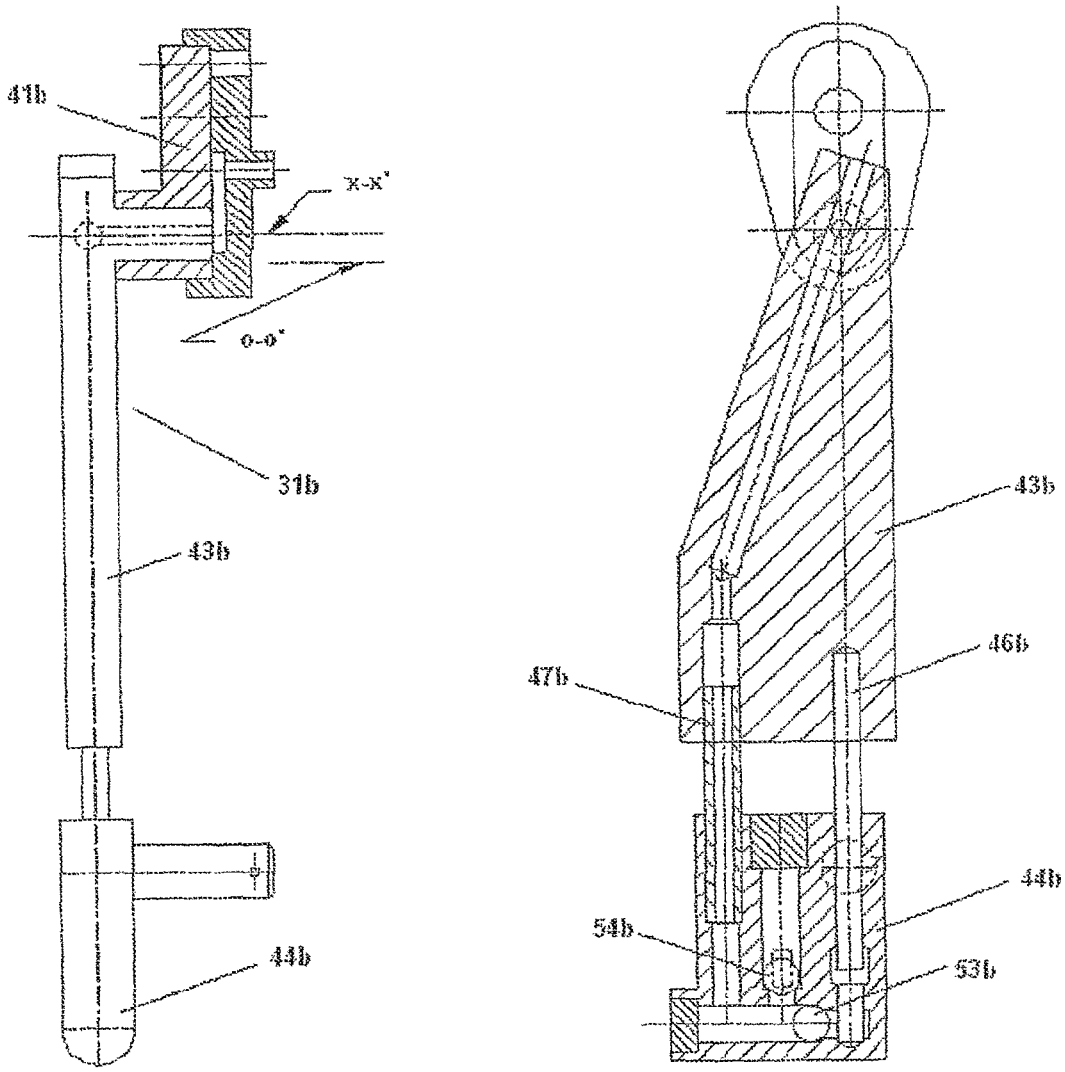
FIG. 19 shows two cross-sectional views, taken along two respective orthogonal planes, of a third version ("C-version") of the reciprocating pump performing an accurate lubrication, according to the present invention.

The precise operation of the pump of the invention will be illustrated with the aid of three versions A, B, C of the same, which are shown respectively in FIGS. 17-19. The three versions are similar and are based on the same principle of suction-delivery. Since the version "B" of FIG. 18 is substantially identical to the version shown in FIGS. 13, 14 and 16, this version will be described first:

The pump includes:

- a lower body-pump, or cylinder-body, denoted by 44*a* and pivoted to the housing 27;
- a piston 46*a;*
- a check valve 53*a;*
- a small hose 47*a;*
- a crank 41*a;*
- a pressure relief valve 54*a*, if required.

The letter "a" added to the numbers denotes this specific version which differs from the other versions of FIGS. 13 and 14 in some specific, immediately comprehensible (but irrelevant) constructive details.

The crank 41*a*, during its rotation around its axis, imposes a relative motion between the piston 46*a* (which is rigidly connected to the piston-pump-body 43*a*), articulated at its upper end in the eccentric hole 55*a* of the crank, and the cylinder-pump 44*a*. This motion corresponds to the traditional reciprocating motion of a classical crank mechanism with a stroke equal to twice the distance between the drive shaft axis O-O' and the eccentric hole of the crank 41*a* (axis X-X').

Starting from the bottom dead centre (BDC), the piston 46*a*, while moving upwards, generates a negative pressure inside the cylinder-pump 44*a*, which is due to the fact that there is no fluid communication to the outside environment, because the suction inlet is closed by the piston itself and the delivery is controlled by the check valve 53*a*. When the piston 46*a* opens the suction inlet obtained in the cylinder-pump 44*a*, lubricant (oil) is sucked through a suction opening which is immersed in the lubricant. When arriving at the top dead centre (TDC) the piston 46*a* inverts its direction of travel; there will be a first phase of backflow of lubricant through the suction inlet 60, and then, after this inlet is closed by the piston 46*a*, the delivery phase starts after opening of the check valve 53*a*, due to the pressure force exerted by the lubricant on this valve 53*a*, which force overcomes the closing force of the spring of the same valve. The lubricant, after passing beyond the check valve 53*a*, flows through the small hose 47*a* and reaches the delivery zone. In this version, the problem of the connection between the pumping zone and the delivery zone—which are in relative motion—is solved by using the flexible tube 47*a*, as explained before. This system may be equipped with a pressure relief valve 54*a*.

Thus, in the version shown in FIG. 18, the oil under pressure which comes from the small hose 47*a* passes through the transversal hole 61 (direction of the hole 61 is orthogonal to the plane of the drawing in FIG. 18 left side), reaching the axial bore 62 which is parallel to the axes O-O and X-X. From there, by passing through channels also shown in the drawing on the left in FIG. 18, this oil reaches the radial hole 63 of the planet carrier 3*a* (in this case only one radial hole 63 is shown, which is in fluid communication with a longitudinal groove 64 obtained on the planet carrier 3*a*). The "C-version" of the lubrication pump according to the present invention, shown in FIG. 19, is identical to the "B-version" of FIG. 18. The only difference is that the lubricant reaches the delivery zone by passing through a supplementary rigid duct. In fact, in this case, the problem of connecting the pumping zone with the delivery zone, which are in relative motion with respect to each other, is solved by using a rigid cylinder element 47*b* that slides within the body-piston 43*b*. Also in this case, the system can be equipped with a pressure relief valve 54*b*. Moreover, also in this case the cylinder-pump 44*b* is connected in an articulated manner (that is, hinged) to the housing 27 in the lower part of the latter.

The version shown in FIG. 17 comprises:

- a cylinder-pump 44*c;*
- a piston 46*c;*
- a check valve 53*c;*
- a suction inlet 45*c* that sucks the oil contained in a housing 27;
- a small rod (link rod) 65;
- a plug 66;
- a crank 41*c*.

The operation of this system is as follows:

The crank 41*c*, by rotating around its own axis, gives rise to a relative motion—by means of the link rod 65—between the piston 46*c* (which is hinged at the eccentric hole of the crank) and the cylinder-pump 44*c*. This motion is the classical reciprocating motion of a conventional crank mechanism, whose stroke equals twice the distance between the axis of the crank O-O' and the axis X-X' of the eccentric hole of the crank. Starting from the bottom dead centre (BDC), the piston 46*c*, while moving upwards, generates a negative pressure inside the cylinder-pump 44*c*, which is due to the fact that there is no fluid communication to the outside environment, because the suction inlet 45*c* remains closed (obstructed) by the piston itself, while the delivery is controlled (closed) by the check valve 53*c*. When the piston 46*c* opens the suction inlet (suction opening) obtained in the cylinder-pump 44*c*, lubricant is sucked through the suction inlet 45*c* immersed in the lubricant (this system is self-starting or "self-priming" provided the negative pressure obtained inside the cylinder insures the lifting of the liquid lubricant from the free, upper surface level, up to the suction opening). Upon reaching the top dead centre (TDC), the piston 46*c* inverts its direction of motion; there will be a first phase of backflow of lubricant through the suction inlet, but then, after the piston has closed this inlet, the delivery phase starts, after the opening of the check valve 53*c* under the pressure force exerted by the compressed lubricant—on this check valve 53*c*—, which overcomes the closure force of the spring of this valve. Thus, the lubricant first flows past the check valve and then through a cavity obtained in the piston 46*c*, until it reaches a delivery region. The plug 66 exerts a backing function (abutment) on the closure spring of the check valve 53*c*. The flow rate (delivery or capacity) of the pump of the invention can be modified by selecting an adequate cylinder bore or a suitable stroke (eccentricity of the hole on the crank).

A further advantage of the lubrication system of the present invention is that the level surface (free surface) of the lubricant can lie even far away from the rotating members of the compressor.

In the following, the third aspect of the present invention will be described, which concerns the improved valve system of a positive-displacement reciprocating compressor.

Figure 20A:
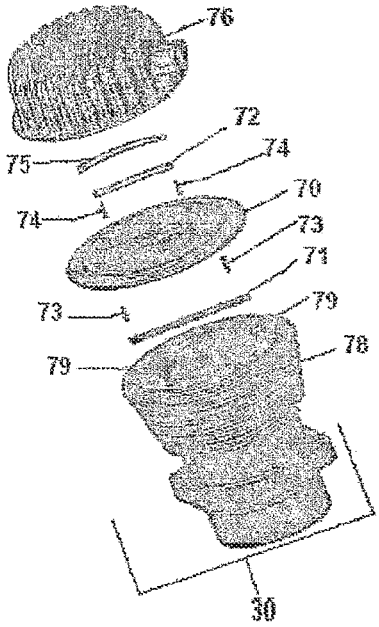
FIGS. 20*a* and 20*b* are perspective views, according to two different angles of observation, of the automatic valve system (system of automatic valves) mounted according to the invention in a reciprocating positive-displacement compressor; in particular, these figures show the assembly formed by: a cylinder/a valve plate/a cylinder head of a single-stage compressor (or of a first stage of a multistage compressor)
Figure 20B:
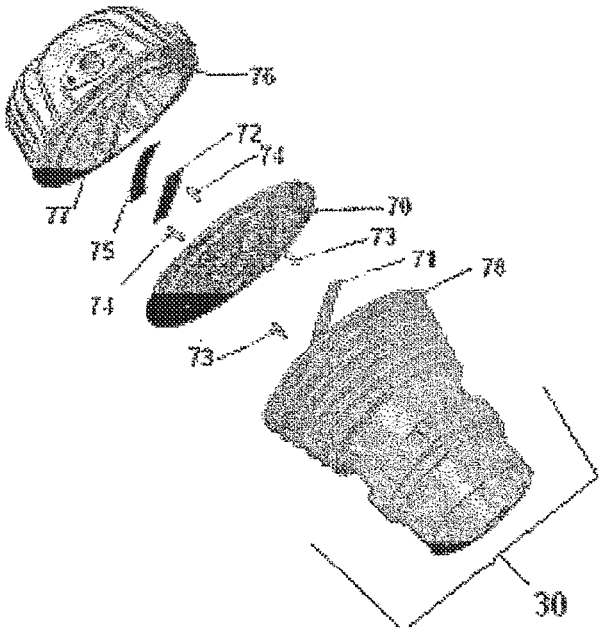
Figure 21:
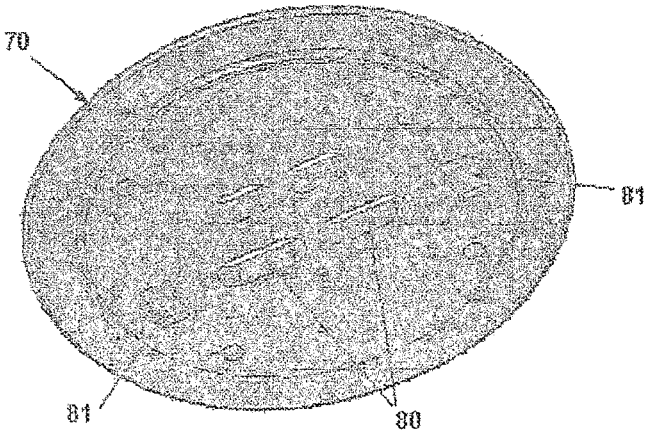
FIG. 21 shows a particular embodiment of the single plate included in the system of automatic valves according to the present invention (FIGS. 20*a* and 20*b*) incorporated in the reciprocating positive-displacement compressor.
Figure 23A:
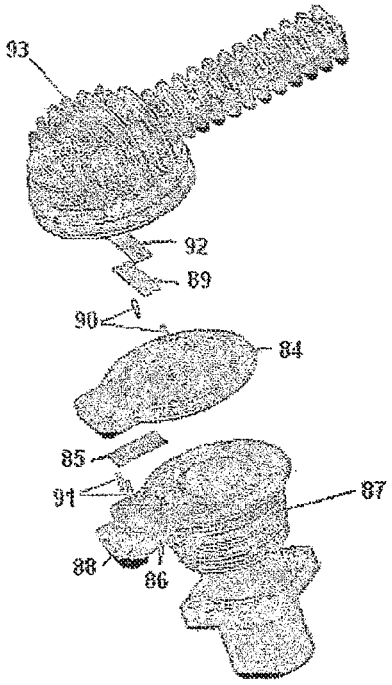
FIG. 23*a* shows, according to a first angle of observation, an automatic valve system (system of automatic valves) of the present invention applicable to multistage compressors, to a further stage located downstream of the first stage.
Figure 23B:
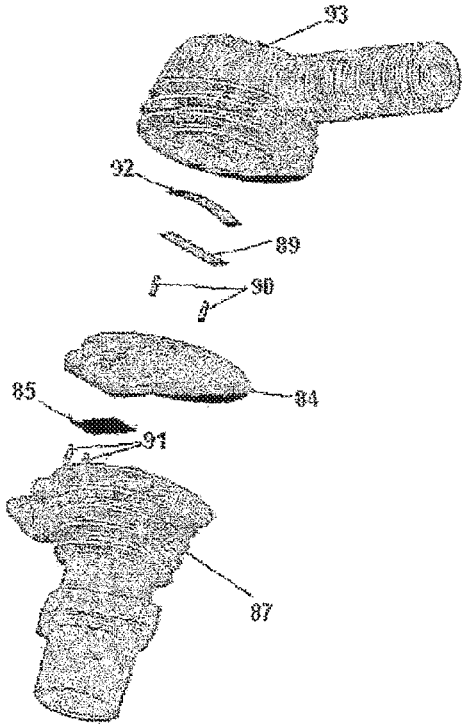
FIG. 23*b* is a view analogous to FIG. 23*a*, but according to a different direction of observation.

The description will be based on FIGS. 20*a*, 20*b*, 21 (illustrating a single-stage compressor, or a first stage of a multistage compressor) and on FIGS. 23*a*, 23*b* (stage downstream of the first stage in a multistage compressor).

The valve system shown in FIGS. 20*a,b*, 21, 22, 23*a, b* is applicable to the field of automatic valves adopted in positive-displacement reciprocating compressors. This valve system has the object of solving some of the abovementioned drawbacks of the conventionally used automatic valves system, both for single-stage compressors and multistage compressors. The invention allows to solve the problem of the filling and emptying of the compressor cylinder, by resorting to a single plate, which is realizable in a simple way, and which has clearances that can be noticeably smaller than those of the conventional solution employing two plates. As an alternative to that solution of the background art which already uses the single plate, in the present case the lamellar blades, which form the valves, are not all connected (fastened) to the plate itself, but may freely bend while remaining always inside their seat, occupying minimal spaces, and insuring an optimum operation both under the fluid dynamic viewpoint (small flow resistance) and from the viewpoint of their duration. This system of automatic valves is shown in FIGS. 20*a* and 20*b* by presenting in exploded view the assembly 'cylinder-valve plate-cylinder head' of a compressor, according to two different directions of observation. The proposed system forms a valid application for single-stage compressors and for the first stage of multistage compressors.

This system of automatic valves is formed by:

- a single valve plate 70 used as "closure head" of the cylinder;
- two adequately shaped lamellar blades 71, 72 of harmonic steel, one of which operates during the suction (71) and the other during the delivery (72), these lamellar blades forming the principal components of the corresponding valves;
- four pins (pegs) 73, 73, 74, 74, two (73) of them being used for laterally retaining the suction lamellar blade (71) and the other two (74) for laterally retaining the delivery lamellar blade (72);
- an optional steel-made protection element 75 interposed between the delivery lamellar blade 72 and the cylinder head 76, or more precisely, between the delivery blade 72 and a stop, or travel-end element 77, for the delivery valve 72.

The assembly is completed by the cylinder body 78 and the cylinder head 76. It should be noted that the cylinder head 76, as follows from FIG. 20*b*, is divided into two sectors (chambers), one of which is designed to guide the suction flow while the other conveys the delivery flow.

It may also be noted that the whole assembly of components (complete cylinder unit) has been denoted by the number 30 in FIG. 13.

The plate 70, and the valves located on it, operate in a way similar to the above description for conventional valves. Also in the present case the lamellar blade 71 opens towards the interior of the cylinder during the piston suction stroke, because of the suction pressure caused by the piston motion. Instead, the lamellar blade 72 opens when the inner pressure determined by the piston on the fluid overcomes the outside pressure value which exists on the delivery side. The lamellar blade 71, which forms the suction valve, has its seat on the upper portion of the cylinder 78 (this seat is directly realised on the upper edge of the cylinder 78, by the milled portions 79) and is guided by the two steel pegs 73, the latter allowing to laterally retain this lamellar blade during its bending (inflexion) stroke without hindering in any way its free inflexion.

The lamellar blade 72 forms the delivery valve and has its seat in the cylinder head 76 of the compressor, wherein a steel-made retainer-element or small plate 75 is interposed and has dimensions corresponding to those of the lamellar blade 72. Also this lamellar blade 72 is laterally guided and retained by the abovementioned steel-made pins or pegs 74, which are fixed into the plate 70 of the automatic valves system: Also in this case the two steel-made pegs 74 allow to laterally guide/retain the lamellar blade during its inflexion (bending) stroke, although they do not hinder its free motion. Like the classical system which includes two plates, the seats of the lamellar blade of the suction valve and of the lamellar blade of the delivery valve are shaped in such a way that they allow the inflexion (bending) of each lamellar blade in one direction only, so that an inversion of the direction of the pressure gradient will not cause any opening of the valves 71 and 72, which therefore operate like check valves.

FIG. 21 shows the plate 70 observed from the side facing the interior of the cylinder 78. It may be noted that two lower slots 80 for the intake flow are aligned with respect to two pockets (recesses) 81 obtained in the valve plate 70, these pockets having the task of promoting an unhindered (that is, free) inflexion of the suction lamellar blade 71, by receiving its ends and facilitating their free bending, in such a way that the lamellar blade can operate without interfering at its ends with the support seats 79; this solution avoids greater stresses that would occur in case of interference and which could lead to a breakage of the lamellar blade due to fatigue. The small, steel-made protection plate 75, which acts as a stop (travel-end element) for the lamellar blade 72 of the delivery valve, must be an element realised with a material resistant to a hammering action and having the shape of the bent lamellar blade; this element is interposed between the lamellar blade 72 and a rib (end-of-stroke element) 77 obtained on the aluminium-made cylinder head 76 of the compressor, so as to prevent any damage to the cylinder head. Note that the design curvature radius of the small plate 75, which must take into account the inflexion degree of the lamellar blade 72 of the delivery valve, must be slightly less than the radius of the abutment rib 77 on the cylinder head, in order to allow a dampening of possible vibrations induced by the lamellar blade 72 on the protection plate 75. The protection plate 75 has the only function of absorbing the hammering effect due to the delivery valve 72 during operation, and it serves also as protection element for the cylinder head 76. The lamellar blades 71 and 72 are held in place, as already specified, by means of said pegs or pins 73 and 74, although any other suitable means could be validly employed for limiting the lateral displacements of the lamellar blades without preventing their free inflexion.

Figure 22:
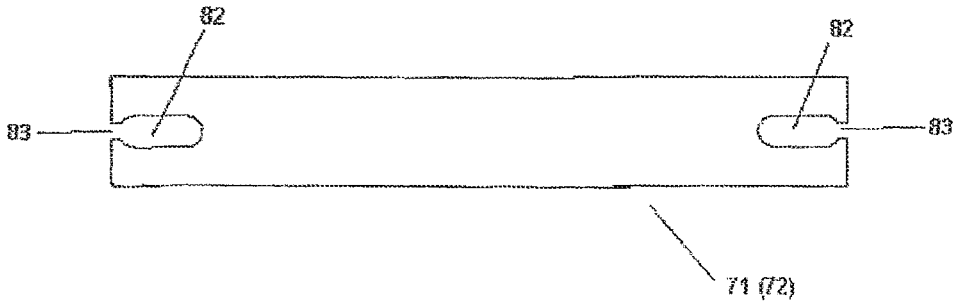
FIG. 22 shows a valve in the form of a lamellar blade, according to the present invention.

When using steel-made pins, these should engage within apposite slots obtained at the ends of the lamellar blades 71, 72. The end slots are necessary in order to insure the natural tendency to shortening—as measured on a plane—of the lamellar blades 71, 72 during their bending. FIG. 22 shows for illustrative purposes the configuration of such a blade. Note that the end slots 82 have cuts 83 on their external edge which serve to simplify the production process and to retain the lamellar blade, in particular the suction lamellar blade, in case of dynamical phenomena that may occur when the compressor is started.

The proposed valve system, which is shown in the above discussed FIGS. 20*a*, 20*b*, 21, 22, 23*a*, 23*b*, has the following advantages:

- reduction of the extent of clearances, since the noxious volume is that which is associated only to the delivery valve. Actually, since the suction or intake valve directly faces the interior of the cylinder, it does not contribute to any clearance (on the contrary, it reduces the latter by a small amount);
- reduction of the number of components, since in the present instance only one valve plate is required in place of the two plates 7, 8 of traditional systems. The reduction in the number of components implies a reduction of required machining processes and related production costs;
- simplification of the assembling operations, because of the lower number of components and because of the impossibility of erroneous assembling;
- solution of the overheating problem for the delivery valve, since this valve is received inside the delivery space (delivery compartment) of the cylinder head and is no more restrained inside a very small space region enclosed by walls at high temperature.

A valve system for applications related to compressor stages following the first stage of a multistage compressor will be described next.

FIGS. 23*a*, 23*b* illustrate, in exploded view, a system of automatic valves according to the present invention, to be applied to compressor stages located downstream of the first stage in a multistage compressor, or generally to all such applications in which the intake fluid or sucked fluid already has a significant amount of pressure or kinetic energy. This system is formed by:

- a plate 84 which receives:
  - the suction valve (or valves), again of the automatic kind, and in the form of a lamellar blade 85 communicating by means of slits or ducts 86 with the upper portion of the cylinder 87, wherein fluid is drawn, at the inlet, from the duct 88 which is connected in turn to a previous stage of the same compressor or of another compressor;
  - the delivery valve (or valves), again of the automatic kind, and in the form of a lamellar blade 89 communicating with the upper portion of the cylinder on the upper side of the plate 84;
  - two adequately shaped lamellar blades made of harmonic steel, one of which 85 is used for the suction step and the other 89 for the delivery step, and which form the main components of the corresponding valves;
  - two lateral confinement pegs 91 for the suction lamellar blade 85 and a corresponding number of pegs 90 for the delivery lamellar blade 89;
  - a steel-made, travel-end element (stop) 92 for the delivery valve, which is only used in case of aluminium-made cylinder heads, and which acts as a protection means.

The cylinder head 93, and the valves mounted thereon, operate in a way similar to conventional valves; also in this case the lamellar blade 85 opens during the suction stroke of the piston, by virtue of the suction pressure caused by the displacement of the piston (not shown) in relation to the flow pressure in the environment from which the fluid is sent, that is, as compared with the pressure of a previous stage of the same compressor or of some other compressor. On the other hand, the lamellar blade 89 opens when the inner pressure of the fluid produced by the piston motion exceeds the pressure of the outside environment, that is, when it exceeds the pressure present on the delivery side. The lamellar blade 85 forming the suction valve, or intake valve, is received in the lateral upper side of the cylinder 87 (this seat is directly formed during the casting process) and its opening movement is limited/guided by the presence of a shaped wall acting as an abutment for the free end of the lamellar blade 85, this wall being formed on the plate 84. The other end of the lamellar blade is fastened by means of said pegs 91 and by the clamping action exerted by the plate 84 on the body of the cylinder 87. Like the already illustrated solution of a single-stage compressor, in this case also, the lamellar blade 89 forming the delivery valve has its seat on the cylinder head 93 of the compressor; moreover, a steel-made retaining plate 92 has been interposed and has a size corresponding to that of the lamellar blade 89. This blade 89 is laterally constrained by the presence of the two steel pegs 90 fixed into the plate 84. In analogy to known systems, the seats of the lamellar blade of the suction valve and of the lamellar blade of the discharge valve are shaped in such a way to allow the inflexion of each of these blades 85, 89 in one direction only, so that an inversion of the direction of the pressure gradient will not cause any opening of the lamellar blades 85 and 89, which therefore act like check valves.

The delivery lamellar blade 89 is totally identical to the already described one (FIG. 22) of a single-stage compressor. From the preceding description, it directly follows a diversity with respect to the previously described version, which is valid for the first stages of reciprocating compressors or for single-stage compressors. The difference lies in the different configuration of the suction valve (intake valve), which in the present case has a travel-end, or end-of-stroke element (a stop), in order to prevent that—due to a possibly greater pressure difference at the inlet of a subsequent stage located downstream of the first stage—a suction valve designed according to the single-stage configuration might be pushed by the pressure into the cylinder or might bent excessively. Actually, the absence of any stop could result in a breakage of the lamellar blade 85, because of fatigue stresses, in a short period of time, Therefore, in the proposed system the fluid is sucked through a duct 88 realised laterally on the cylinder 87 and terminating, through apposite slits 86 (FIG. 23*a*), on the upper face (surface) of the cylinder 87, said slits being closed by the suction lamellar blade (or by several suction lamellar blades) 85 which is (are) cantilevered and operates (operate) in this way and is (are) fixed by two respective pegs 91. The travel-end means, or abutment means, for the suction lamellar blade(s) 85 are realised—as already mentioned above—by the valve plate 84 which is appropriately shaped (FIG. 23*b*). The further section of the suction duct is defined by the walls of the valve plate 84 and by the upper part of cylinder 87. The proposed system, which was illustrated by way of a non-limitative example in FIGS. 23*a* and 23*b*, has the following advantages with respect to already known systems:

- a reduction of clearances since the noxious volume is the sum of the volume affecting the delivery valve (which is extremely small since the valve directly faces the cylinder) and the volume affecting the suction valve (which is extremely small since the valve seat has been shifted laterally with respect to the outside edge of the cylinder);
- a reduction in the number of components, since in this embodiment only one plate is necessary for the delivery valve, which also incorporates the components required by the suction valve, as opposed to the two plates of traditional systems which in total give rise to greater clearances. Also in this case the reduction of components, and therefore the use of a single plate, implies a reduction of machining steps and production costs;
- a simplification of the assembling operations, due to the utilisation of a single plate and the impossibility of carrying out an incorrect assembling;
- a solution of the overheating problem for the delivery valve, since this valve is received inside the delivery space of the cylinder head and therefore it is no more confined inside a strait space surrounded by walls at high temperature;
- an elimination of the problem of heat exchange between sucked (incoming) fluid and compressed fluid, as opposed to traditional systems in which this exchange occurs through the narrow septum (dividing wall) between the two adjacent
- compartments inside the cylinder head. In the proposed system the sucked fluid is not subjected to this heating effect, and this reduces the compression work.

The present invention has been described in detail by means of several embodiments and variants only to enable a skilled person to understand and directly put into practice the improvements made to conventional, positive-displacement reciprocating compressors. These embodiments should therefore not be interpreted narrowly, or in a binding way, in particular with respect to the employed materials. This means that every component could be realised in any material suited to the same functions and which already belongs to the background art. For instance, in place of sintered steel, one could employ any other sintered material suited to accomplish the same functions.

The materials used to manufacture the lamellar blades of the valves may be of any kind suited to perform the same functions, such as resisting to high temperatures withstanding repeated bending (dynamic forces), etc.

The shape of the valve seats illustrated in the figures is not binding, and the same holds for the peg system (pins) used to fasten the lamellar blades; the only relevant issue is that the lamellar blades must be capable of bending themselves while sliding at their ends in a substantially unhindered manner. Therefore, any means suited for this task could be used.

The invention claimed is:

1. A positive displacement reciprocating compressor comprising one or more cylinder units (30), respective pistons (5, 5') reciprocating inside said cylinder units (30), at least one motor (25) having a respective drive shaft (3') with a planet carrier (3), a planet (20) which, in combination with said planet carrier (3) and with a crown wheel (2; 26) with internal toothing realises a so-called "non-conventional" crank mechanism in which a point "B" on the pitch line of a pinion (4) of the planet (20) moves according to a reciprocating rectilinear motion during the operation of the compressor, the compressor further including a housing (27) with a corresponding cover (32) and being characterised in that

- at least a part, but preferably all, of the components of the planet (20) of said "non-conventional" crank mechanism, are formed of sintered material, preferably sintered steel;
- the positive-displacement reciprocating compressor further comprises a lubrication system (31; 31*a*, 31*b*; 31*c*) which sends in an accurate manner lubricant oil under pressure to surfaces which are in mutual contact and in relative rotational motion to each other and which belong to components (3, 20) of said "non-conventional" crank mechanism, said lubrication system (31; 31*a*; 31*b*; 31*c*) drawing the mechanical energy required for its motion directly from the planet carrier (3), without requiring, however, any other kind of energy supply means.

2. A positive-displacement reciprocating compressor according to claim 1, characterised in that said lubrication system (31; 31*a*; 31*b*; 31*c*) forms a suction-and-delivery system of lubricant oil, which operates according to a classical crank mechanism with a piston and a cylinder.

3. A positive-displacement reciprocating compressor according to claim 1, wherein said crown wheel (2; 26) is also made of sintered material, preferably sintered steel.

4. A positive-displacement reciprocating compressor according to claim 2, wherein said lubrication system (31; 31*a*; 31*b*, 31*c*) comprises a suction piston (46; 46*a*; 46*b*; 46*c*) having the shape of a needle, sliding inside a cylinder-pump (44; 44*a*; 44*b*; 44*c*) hinged to a housing (27), the cylinder-pump containing a check valve (53*a*; 53*b*; 53*c*) and presenting a suction inlet (45; 45*c*) located below the free level surface of the lubricant oil contained in the housing or oil sump (27), a delivery duct being also provided, which is located downstream of the check valve (53*a*; 53*b*; 53*c*) in order to feed the oil to a piston-pump-body (43; 43*a*; 43*b*; 43*c*) and a crank (41; 41*a*; 41*b*; 41*c*) which are operatively connected to said planet carrier in order to draw the mechanical energy from the latter and for sending the oil lubricant to said surfaces which are in mutual contact and in relative rotational motion to each other.

5. A positive-displacement reciprocating compressor according to claim 1, wherein said planet (20) includes a pinion (4), a counterweight (21), and an eccentric disk (22) forming an integral, that is monolithic piece of sintered material, preferably sintered steel.

6. A positive-displacement reciprocating compressor according to claim 1, wherein said planet (20) comprises a pinion (4), a counterweight (21), and an eccentric disk (22), which form separate components, realised through independent sintering processes and inside separate moulds.

7. A positive-displacement reciprocating compressor according to claim 1, wherein the components of sintered material which form the planet (20) and/or the crown wheel (2; 26) are subjected to heat treatments such as carburising and sinter-hardening, the latter process occurring simultaneously with the sintering process.

8. A positive-displacement reciprocating compressor according to claim 1, wherein the lubrication system is obliged to oscillate in a plane by virtue of the presence of an element (33) elastically connected (34) with the cover (32) of the housing (27) and interposed between this cover, on one side, and the lubrication system and the crown wheel (2; 26) on the other side; said element (33) having tooth-like protrusions which engage with cross-like extensions or arms formed on the outside circumference of the crown wheel (26).

9. A positive-displacement reciprocating compressor according to claim 1, wherein said cylinder units (30) comprise a cylinder head (76; 93), a system of valves (70, 71, 72;

84, 85, 89), and a cylinder (78; 87), the system of valves being formed by a single valve plate (70 or 84) and by lamellar blade valves (71, 72; 85, 89) which open and close automatically and which, in their closure position, are in contact with one side of said valve plate (70 or 84) or with a lateral extension of the upper portion of the cylinder (87).

10. A positive-displacement reciprocating compressor according to claim 9, wherein the delivery valve(s) (72; 89) of said system of valves form each a respective lamellar blade valve (72; 89) which is constrained and connected at its ends to said valve plate (70; 84) but which can slide freely at these ends, in such a way as to be capable of bending and opening the valve delivery apertures formed on the same valve plate (70; 84).

11. A positive-displacement reciprocating compressor according to claim 10, wherein the delivery valve, or each delivery valve (72; 89), has a travel-end element, or stop (77), on the cylinder head (76; 93).

12. A positive-displacement reciprocating compressor according to claim 11, wherein a protection element (75, 92) is associated with each stop (77), this protection element having essentially the same contour and shape as the lamellar blade of the delivery valve, but a curvature radius suited to dampen the vibrations of the lamellar blade (72; 89) and to protect from hammering and wear said stop or travel-end element (77) formed on said cylinder head.

13. A positive-displacement reciprocating compressor according to claim 12, wherein said protection element (75, 92) is manufactured with a material which is more resistant to wear than the material used to manufacture the cylinder head (76, 93) of the cylinder unit (30).

14. A positive-displacement reciprocating compressor, forming the first stage of a multistage compressor, or a single stage compressor, according to claim 9, wherein a septum, or dividing wall, divides the cylinder head (76) of a cylinder unit (30) into a first compartment and a second compartment, the lamellar blade or lamellar blades of the delivery valve(s) (72) being lodged inside the first compartment, and the second compartment being located in alignment with the lamellar blade suction valve(s) (71) which is(are) located on the opposite side of the valve plate (70) with respect to the delivery valve(s) (72).

15. A positive-displacement reciprocating compressor according to claim 14, wherein said lamellar blade suction valve(s) (71) each form a lamellar blade valve (71) which is constrained and connected at its ends to said valve plate (70) but is free to slide at these ends so as to be able to bend and open the apertures (80) of the suction valve which are formed on the same valve plate (70).

16. A positive-displacement reciprocating compressor according to claim 15, wherein pockets or recesses (81) are formed on one face of the valve plate (70) which faces the cylinder (78) in order to avoid interferences between the lamellar blade (71) of the suction valve and the valve plate (70) during the opening phase of the suction valve.

17. A positive-displacement reciprocating compressor according to claim 9, which forms a multistage compressor, wherein a cylinder unit of a stage arranged downstream of the first stage presents a suction valve (85) located on said lateral extension of the upper part of the cylinder (87), so that a heat exchange is substantially avoided between the sucked fluid and the compressed, delivery fluid, said suction valve (85) being fixed and clamped at only one end between an extension of the valve plate (84) and said lateral extension of the upper part of the cylinder (87); and wherein, in order to avoid the breakage due to fatigue of the suction valve, caused by the incoming fluid pressure from the previous stage, the suction valve (85) has a stop or abutment surface on the valve plate (84).

18. A reciprocating compressor according to claim 17, wherein the cylinder head (93) of the cylinder unit encloses a single, inner chamber, which has no dividing wall, and which is crossed by the delivery fluid, that is, the outgoing fluid.

19. A positive-displacement reciprocating compressor according to claim 9, wherein said lamellar blades of the suction valve and of the delivery valve are made of harmonic steel.

20. A positive-displacement reciprocating compressor according to claim 9, in which the cylinder heads of the cylinder units are made of aluminium or cast iron.

21. A positive-displacement reciprocating compressor according to claim 12, in which the anti-hammering protection elements of the delivery lamellar blade valves are made of steel and have a contour and shape substantially identical to the contour and shape of the delivery valves, and moreover they have a radius of curvature which is slightly less than that of the stops or travel-end elements (77) before completion of the assembling operation of the cylinder unit.

* * * * *